US012473163B2

(12) United States Patent
Takahashi et al.

(10) Patent No.: US 12,473,163 B2
(45) Date of Patent: Nov. 18, 2025

(54) SHEET CONVEYING DEVICE AND IMAGE FORMING APPARATUS INCORPORATING THE SHEET CONVEYING DEVICE

(71) Applicants: Motoharu Takahashi, Kanagawa (JP); Hideaki Suzuki, Kanagawa (JP)

(72) Inventors: Motoharu Takahashi, Kanagawa (JP); Hideaki Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 226 days.

(21) Appl. No.: 18/515,286

(22) Filed: Nov. 21, 2023

(65) Prior Publication Data

US 2024/0174470 A1 May 30, 2024

(30) Foreign Application Priority Data

Nov. 24, 2022 (JP) ..... 2022-187428

(51) Int. Cl.
*B65H 29/68* (2006.01)
*B65H 7/10* (2006.01)

(52) U.S. Cl.
CPC ..... *B65H 7/10* (2013.01); *B65H 2513/10* (2013.01); *B65H 2513/51* (2013.01)

(58) Field of Classification Search
CPC . B65H 9/002; B65H 7/08; B65H 7/10; B65H 29/68; B65H 2513/10; B65H 2513/51
USPC ..... 271/184, 185, 202
See application file for complete search history.

(56) References Cited

U.S. PATENT DOCUMENTS

| | | | | |
|---|---|---|---|---|
| 5,092,451 | A * | 3/1992 | Jones | B65G 47/31 198/444 |
| 6,629,593 | B2 * | 10/2003 | Zeitler | B65G 43/08 198/460.3 |
| 7,845,629 | B2 * | 12/2010 | Mitsuya | B65H 7/18 271/96 |
| 9,957,114 | B2 * | 5/2018 | Beesley | B65G 47/31 |
| 10,106,354 | B2 * | 10/2018 | Karikusa | B65H 9/103 |
| 10,358,309 | B2 * | 7/2019 | Yamane | G03G 15/6567 |
| 10,875,728 | B2 * | 12/2020 | Yamane | G03G 15/6582 |
| 11,427,423 | B2 * | 8/2022 | Maeyama | B65H 7/08 |

(Continued)

FOREIGN PATENT DOCUMENTS

| | | |
|---|---|---|
| JP | 2005-053646 A | 3/2005 |
| JP | 2019-099380 A | 6/2019 |
| JP | 2020-147425 A | 9/2020 |

*Primary Examiner* — Leslie A Nicholson, III
(74) *Attorney, Agent, or Firm* — XSENSUS LLP

(57) ABSTRACT

A sheet conveying device includes a sensor, a corrector, and circuitry. The sensor detects a position of a first sheet and multiple second sheets. The corrector corrects the position of the sheet in at least one of a rotational direction or a width direction. The circuitry is to convey the multiple second sheets at a first conveyance speed, reduce the first conveyance speed of a preceding one of the multiple second sheets to a second conveyance speed until a space between the preceding one and a subsequent one of the multiple second sheets becomes a difference between a first length of the first sheet and a second length of the multiple second sheets, and cause the corrector to convey one of the multiple second sheets at the second conveyance speed within at least a part of time in which said one of the multiple second sheets is conveyed.

8 Claims, 14 Drawing Sheets

(56) References Cited

U.S. PATENT DOCUMENTS

| | | | |
|---|---|---|---|
| 2013/0161900 | A1 | 6/2013 | Takahashi et al. |
| 2017/0001822 | A1 | 1/2017 | Asano et al. |
| 2018/0093841 | A1 | 4/2018 | Momose et al. |
| 2019/0161299 | A1 | 5/2019 | Egawa et al. |
| 2019/0161301 | A1 | 5/2019 | Maeyama et al. |
| 2019/0241385 | A1 | 8/2019 | Kaneko et al. |
| 2019/0276258 | A1 | 9/2019 | Egawa et al. |
| 2019/0283998 | A1 | 9/2019 | Uchida et al. |

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2022-187428, filed on Nov. 24, 2022, in the Japan Patent Office, the entire disclosure of which is hereby incorporated by reference herein.

BACKGROUND

Technical Field

Embodiments of the present disclosure relate to a sheet conveying device and an image forming apparatus incorporating the sheet conveying device.

Background Art

Various sheet conveying devices are known that convey sheets such as papers and original documents in an image forming apparatus such as a copier and a printer.

Such sheet conveying devices employ a method to contact the leading end of a sheet to a nip region of a conveyance roller pair to correct skew of the sheet, and rotate the conveyance roller pair to convey the sheet.

In order to convey the sheet with good accuracy without decreasing the productivity, a sheet conveying device in the art is proposed that moves a conveyance roller pair in a direction opposite a sheet conveyance direction while the conveyance roller pair conveys the sheet and correct the positional deviation (displacement) of the sheet.

As described above, by correcting the positional deviation (displacement) of the sheet while conveying the sheet, the sheet can be conveyed with good accuracy without deteriorating the productivity.

SUMMARY

Embodiments of the present disclosure described herein provide a novel sheet conveying device including a sensor, a corrector, and circuitry. The sensor detects a position of a sheet among a first sheet having a first length and multiple second sheets each having a second length shorter than the first length in a sheet conveyance direction of the sheet. The corrector corrects the position of the sheet in at least one of a rotational direction or a width direction orthogonal to the sheet conveyance direction within a plane of sheet conveyance based on the position of the sheet detected by the sensor. The circuitry is to convey the multiple second sheets at a first conveyance speed, reduce the first conveyance speed of a preceding one of the multiple second sheets to a second conveyance speed lower than the first conveyance speed until a space between a trailing end of the preceding one of the multiple second sheets and a leading end of a subsequent one of the multiple second sheets becomes a difference between the first length of the first sheet and the second length of the multiple second sheets in the sheet conveyance direction while continuously conveying the multiple second sheets, and cause the corrector to convey one of the multiple second sheets at the second conveyance speed within at least a part of time in which said one of the multiple second sheets is conveyed by the corrector.

Further, embodiments of the present disclosure described herein provide an image forming apparatus including the above-described sheet conveying device and an image former to form an image on the sheet conveyed by the sheet conveying device.

BRIEF DESCRIPTION OF THE SEVERAL VIEWS OF THE DRAWINGS

Exemplary embodiments of this disclosure will be described in detail based on the following figures, wherein.

Figure 1:
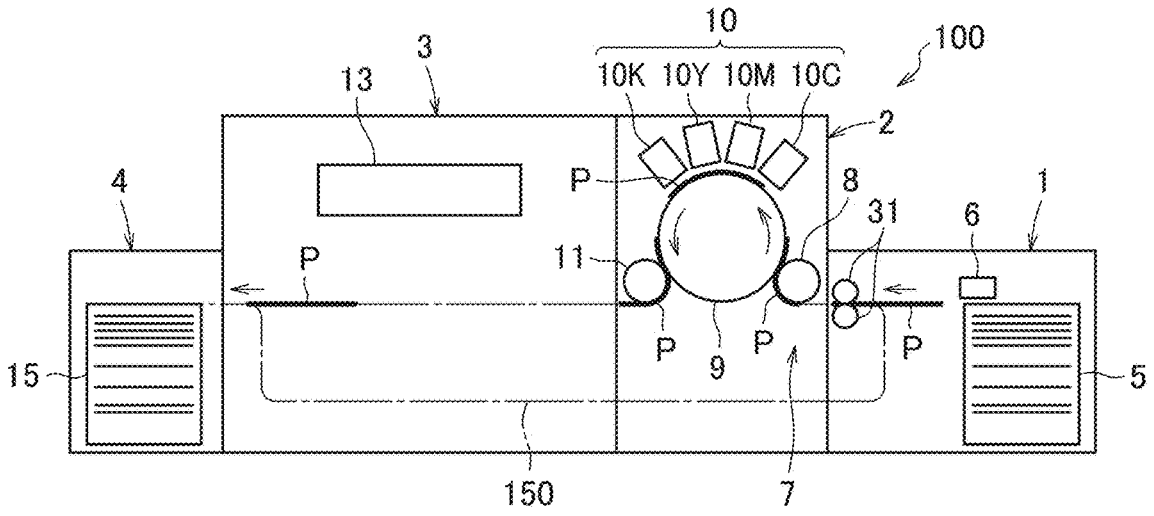
FIG. 1 is a diagram illustrating an overall configuration of an inkjet image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the present disclosure are described below in detail with reference to the drawings. It is to be understood that an identical or similar reference character is given to identical or corresponding parts throughout the drawings, and redundant descriptions are omitted or simplified below.

With reference to drawings, descriptions are given below of embodiments of the present disclosure. In the drawings for illustrating embodiments of the present disclosure, elements, or components identical or similar in function or shape are given identical reference numerals as far as distinguishable, and redundant descriptions are omitted.

FIG. 1 is a diagram illustrating an overall configuration of an inkjet image forming apparatus according to an embodiment of the present disclosure.

Overall Configuration

An image forming apparatus 100 according to the present embodiment includes a sheet feeding device 1, an image forming device 2, a drying device 3, and a sheet ejecting device 4. The image forming apparatus 100 further includes a sheet conveying device 7 that conveys a sheet fed from the sheet feeding device 1 and ejected to the sheet ejecting device 4 by passing through the image forming device 2 and the drying device 3.

A "sheet" is described as an example of a recording medium including a "paper" in the following embodiments. However, the "sheet" is not limited to a sheet of paper. For example, the "sheet" includes not only the sheet of paper but also an overhead projector (OHP) transparency sheet, a fabric, a metallic sheet, a plastic film, and a prepreg sheet including carbon fibers previously impregnated with resin. In addition, the term "sheet" is not limited to a sheet such as a plain paper but also is applicable to thick paper, post card, envelope, thin paper, coated paper, art paper, and tracing paper.

As illustrated in FIG. 1, as the sheet P is fed from the sheet feeding device 1 to the image forming device 2, ink is discharged to the sheet P in the image forming device 2 to form an image on the sheet P. Then, the sheet P is conveyed to the drying device 3 where a drying operation is performed onto the sheet P. After the drying operation, the sheet P is conveyed to the sheet ejecting device 4 to which the sheet P is ejected. In duplex printing, an image is formed on the front face (in other words, the first face) of the sheet P in the image forming device 2. Then, the drying operation is performed on the sheet P in the drying device 3, and the sheet P is not ejected to the sheet ejecting device 4 but is conveyed to a reverse conveyance passage 150. The sheet P that has passed through the reverse conveyance passage 150 is reversed and conveyed to the image forming device 2 again. In the image forming device 2, an image is formed on the back face (in other words, the second face) of the sheet P. Then, the sheet P is dried through the drying operation in the drying device 3 and is ejected from the sheet ejecting device 4.

Sheet Conveying Device

The sheet conveying device 7 includes a correction roller pair 31 as a pair of collection rollers, a first transfer cylinder 8, as, and a second transfer cylinder 11. The correction roller pair 31 serves as a sheet conveyor to convey the sheet P that is fed from the sheet feeding device 1 and also as an adjuster that adjust (correct) the position of the sheet P. On the other hand, each of the first transfer cylinder 8, the sheet bearing drum 9, and the second transfer cylinder 11 serves as a rotary sheet conveyor to hold the sheet P on the outer circumferential face to convey the sheet P. The first transfer cylinder 8, the sheet bearing drum 9, and the second transfer cylinder 11 are disposed in this order toward the downstream side in the sheet conveyance direction. Accordingly, the sheet P is transferred from the first transfer cylinder 8 to the sheet bearing drum 9, and is further transferred from the sheet bearing drum 9 to the second transfer cylinder 11 to be conveyed toward the downstream side in the sheet conveyance direction.

Sheet Feeding Device

The sheet feeding device 1 includes a sheet tray 5, a sheet feeder 6, and a sheet conveying device 7. The sheet tray 5 stacks multiple sheets P. The sheet feeder 6 separates the multiple sheets P one by one from the sheet tray 5 to feed the separated sheet P. The sheet feeder 6 can use various sheet feeders, for example, a sheet feeder employing a roller or a roller unit or a sheet feeder employing an air suction unit. The sheet P fed from the sheet tray 5 by the sheet feeder 6 is conveyed to the image forming device 2 by the sheet conveying device 7.

Image Forming Device

The image forming device 2 includes a liquid discharger 10 to discharge liquid ink to the sheet P carried on the sheet bearing drum 9. The liquid discharger 10 according to the present embodiment includes liquid discharging heads 10C, 10M, 10Y and 10K having different colors of C (cyan), M (magenta), Y (yellow), and K (black), respectively, to form an image. The configuration of each of the liquid discharging heads 10C, 10M, 10Y and 10K is not limited to the above-described configuration and any other configuration may be applied as long as each liquid discharging head discharges liquid. Another liquid discharging head that discharges special ink such as white, gold and silver may be added to the liquid discharger 10 or yet another liquid discharging head that discharges a surface coating liquid that does not form an image may be provided to the liquid discharger 10.

Respective discharging operations of the liquid discharging heads 10C, 10M, 10Y and 10K are individually controlled by respective drive signals according to image data. When a sheet P carried on the sheet bearing drum 9 reaches an opposing region facing the liquid discharger 10, respective color inks are discharged from the liquid discharging heads 10C, 10M, 10Y and 10K, so that an image is formed according to the image data.

Drying Device

The drying device 3 includes a dryer 13 to dry ink discharged on the sheet P. The dryer 13 includes a heat roller including a heating unit such as a heater inside. As the sheet P is conveyed while contacting the surface of the heat roller, the sheet P is heated. By so doing, the liquid content such as moisture (liquid) in the ink is evaporated. For this reason, the ink is fixed onto the sheet P and curling of the sheet P is restrained. Alternatively, the dryer 13 may be an air generator that blows hot air or cold air onto the sheet P.

Sheet Ejection Device

The sheet ejection device 4 includes a sheet ejection tray 15 onto which multiple sheets P are ejected and stacked. The sheets P that are sequentially conveyed from the drying device 3 to the sheet ejection device 4 are overlaid one after another and stacked on the sheet ejection tray 15. The configuration of the sheet ejecting device 4 according to the present embodiment is not limited to the above-described configuration and any other configuration may be applied as long as the sheet ejection device 4 discharges the sheet P or the multiple sheets P.

Other Additional Functional Devices

As described above, the inkjet image forming apparatus 100 according to the present embodiment typically includes the sheet feeding device 1, the image forming device 2, the drying device 3, the sheet ejecting device 4, and the sheet conveying device 7. However, other functional devices may be added appropriately. For example, the inkjet image forming apparatus 100 may further include a pre-processing device between the sheet feeding device 1 and the image forming device 2 to perform pre-processing operations of image formation. The inkjet image forming apparatus 100 may further include a post-processing device between the drying device 3 and the sheet ejecting device 4 to perform post-processing operations of image formation.

For example, the inkjet image forming apparatus 100 may employ a pre-processing device that performs a processing liquid applying operation to apply processing liquid onto the sheet P so as to reduce bleeding of the processing liquid due to reaction with ink. However, the content of the pre-processing operation is not limited particularly. Further, for example, the inkjet image forming apparatus 100 may employ a post-processing device that performs sheet reversing and conveying operations to reverse the sheet P having an image formed in the image forming device 2 and convey the sheet P to the image forming device 2 again to form images on both sides of the sheet P or performs a binding operation to bind the multiple sheets P having respective images formed on both sides of the sheet P. However, the content of the post-processing operation is not limited particularly.

The term "image" to be formed on a sheet is not limited to visible significant images such as texts and figures but includes, for example, patterns that themselves have no meaning.

In addition, the term "sheet" on which the image is formed is not limited to limited materials but may include any object to which liquid can be temporarily attached, for example, paper, thread, fiber, cloth, leather, metal, plastic, glass, wood and ceramics, or any object to be used for film products, cloth products such as clothing, building materials such as wallpaper and flooring materials and leather products. The term "liquid" is not particularly limited as long as the liquid has a viscosity and a surface tension that can be discharged from the liquid discharging head. However, but it is preferable that the liquid has a viscosity of 30 mPa (center dot)s or less at normal temperature and normal pressure or by heating and cooling. More specifically, the liquid includes a solvent such as water or an organic solvent, a solution including a coloring agent such as a dye or a pigment, a functionalizing material such as a polymerizable compound, a resin or a surfactant, a biocompatible material such as DNA, amino acid, protein or calcium, edible materials such as natural pigments, or suspension or emulsion. These liquids can be used for ink for inkjet printing and surface treatment liquid, for example.

In addition, the term "inkjet image forming apparatus" indicates an apparatus in which liquid discharging head(s) and a sheet material move relatively but is not limited to the above-described apparatus. For example, the "liquid discharge apparatus" may be, for example, a serial head apparatus that moves the liquid discharge head or a line head apparatus that does not move the liquid discharge head.

Further, the term "liquid discharge head" indicates a functional component that discharges or injects liquid from liquid discharging holes (nozzles). As an energy generation source for discharging liquid, a discharging energy generator, e.g., a piezoelectric actuator (i.e., a stacked piezoelectric element and a thin film piezoelectric element), a thermal actuator using an electrothermal transducer such as a heating resistor, and an electrostatic actuator including a diaphragm and a counter electrode, can be used. However, the discharging energy generator to be used is not limited.

A detailed description is now given of the configuration of the sheet conveying device 7 according to the present embodiment.

Figure 2:
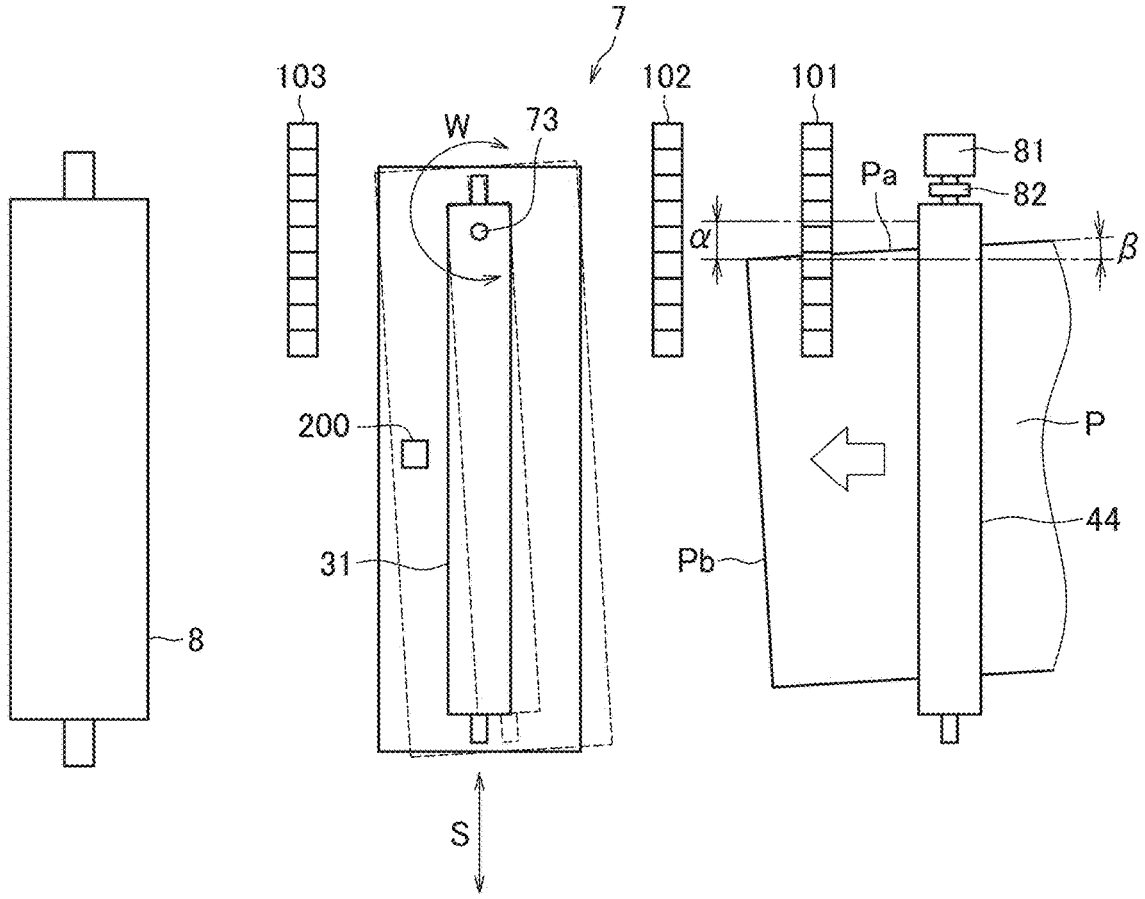
FIG. 2 is a plan view of a sheet conveying device according to an embodiment of the present disclosure, the sheet conveying device being included in the inkjet image forming apparatus of FIG. 1.

FIG. 2 is a plan view of the sheet conveying device 7 according to the present embodiment.

As illustrated in FIG. 2, the sheet conveying device 7 includes the above-described correction roller pair 31, an upstream conveyance roller pair 44 serving as an upstream conveyor disposed upstream from the correction roller pair 31 in the sheet conveyance direction, three CISs that are the first CIS 101, the second CIS 102 and the third CIS 103, and a leading end detection sensor 200.

The leading end detection sensor 200 is a leading end detector that detects the leading end position of the sheet P to calculate a target conveyance timing for conveying the sheet P to the first transfer cylinder 8. The leading end detection sensor 200 is, for example, a reflective optical sensor and is disposed downstream from the correction roller pair 31 in the sheet conveyance direction.

Each of the three sensors, which are the first CIS 101, the second CIS 102 and the third CIS 103, is a position detector that detects the position of the sheet P to calculate the displacement amount of the sheet P. The "CIS" of the first CIS 101, the second CIS 102, and the third CIS 103 stands for a contact image sensor that currently contributes to a reduction in size of a device. The CIS uses small-size LEDs (light emitting diodes) as a light source to directly read an image by a linear sensor via a lens. Each of the first CIS 101, the second CIS 102, and the third CIS 103 includes multiple line sensors aligned in the width direction of the sheet P (i.e., a direction intersecting with the sheet conveyance direction or a direction orthogonal to the sheet conveyance direction) so as to detect a side end Pa (see FIG. 2) of one end side in the width direction of the sheet P. In the following description, the first CIS 101 functions as a first position detector, the second CIS 102 functions as a second position detector, and the third CIS 103 functions as a third position detector. The first CIS 101 and the second CIS 102 are disposed between the correction roller pair 31 and the upstream conveyance roller pair 44 in the conveyance direction. On the other hand, the third CIS 103 is disposed between the correction roller pair 31 and the first transfer cylinder 8 that serves as a downstream conveyor disposed downstream from the correction roller pair 31 in the sheet conveyance direction.

The correction roller pair 31 moves in the width direction (i.e., in a direction indicated by arrow S in FIG. 2) of the sheet P while nipping the sheet P under conveyance and rotates about the support shaft 73 within a plane of sheet conveyance (i.e., in a direction indicate by arrow W in FIG. 2). The correction roller pair 31 moves in the width direction of the sheet P and rotates around the support shaft 73 within a plane of sheet conveyance while holding the sheet P under conveyance. By so doing, the correction roller pair 31 changes (adjusts) the position of the sheet P. As a result, the lateral displacement $\alpha$ of the sheet P and the angular displacement $\beta$ of the sheet P are corrected. In the present embodiment, the support shaft 73 is provided on the one end side in the axial direction of the correction roller pair 31. However, the position of the support shaft 73 is not limited to this position. For example, the support shaft 73 may be provided at the axial center position of the correction roller pair 31.

Figure 3:
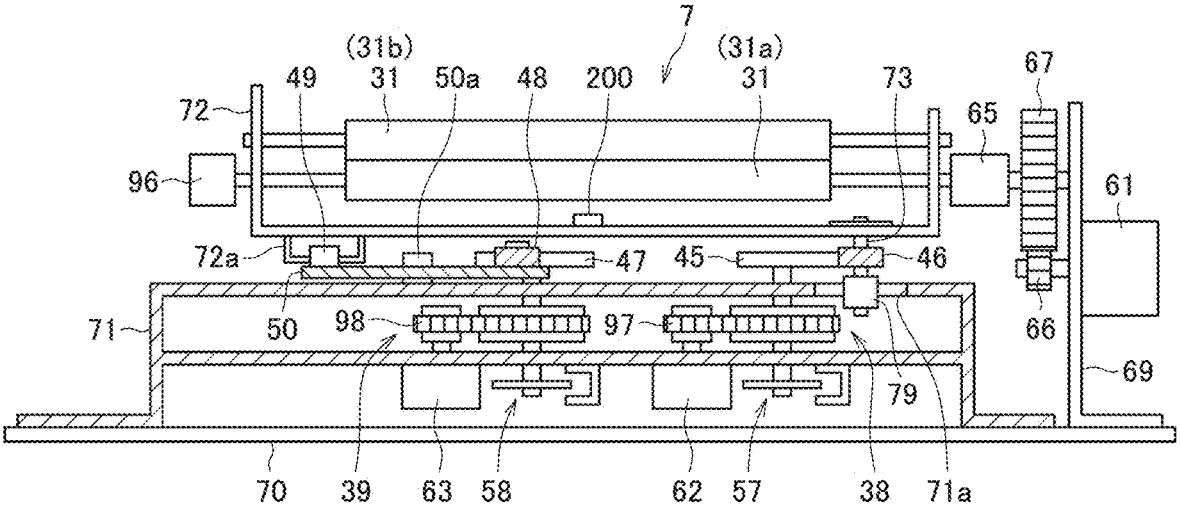
FIG. 3 is a side view of a driving mechanism that drives a correction roller pair.
Figure 4:
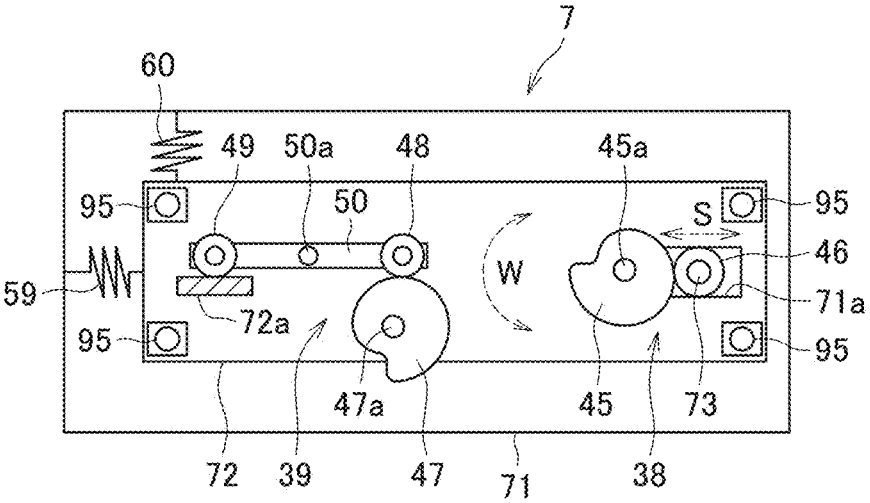
FIG. 4 is a plan view of the driving mechanism that drives the correction roller pair.

FIGS. 3 and 4 are diagrams illustrating the correction roller pair 31 and a driving mechanism to drive the correction roller pair 31.

FIG. 3 is a side view of the driving mechanism that drives the correction roller pair 31.

FIG. 4 is a plan view of the driving mechanism of FIG. 3.

As illustrated in FIG. 3, the correction roller pair 31 as a pair of correction rollers includes a drive roller 31*a* and a driven roller 31*b*. The drive roller 31*a* drives to rotate around a roller shaft extending in the width direction of a sheet P. The driven roller 31*b* is rotated along with rotation of the drive roller 31*a*. The drive roller 31*a* and the driven roller 31*b* are rotatably held by a holder frame 72 that functions as a holding body to rotate around the roller shaft. The holder frame 72 is supported by a base frame 71 fixed to a body frame 70 of the inkjet image forming apparatus 100.

As illustrated in FIG. 4, the holder frame 72 is mounted on the base frame 71 via free bearings (ball transfers) 95 that function as a relay support. As a result, the holder frame 72 is movable in any direction within a plane of sheet conveyance (i.e., within a plane of conveyance of a sheet) along the upper surface of the base frame 71. As described above, by supporting the holder frame 72 using the free bearings 95, the friction load generated when the holder frame 72 moves can be made extremely small. Accordingly, the correction of the angular and lateral displacements of the sheet P, which is described below, is performed at high speed and with high accuracy. In the present embodiment, the holder frame 72 is supported by the four free bearings 95. However, the number of the free bearings 95 is not limited to four. For example, the number of the free bearings 95 may be three or more.

Further, as illustrated in FIG. 3, the holder frame 72 includes the support shaft 73 that is as a rotation center of the correction roller pair 31 within a plane of sheet conveyance. The support shaft 73 is provided extending downwardly. The lower end portion of the support shaft 73 is inserted into a lateral guide portion 71*a* formed in the base frame 71. The lateral guide portion 71*a* is an opening or a hole portion formed so as to extend substantially linearly in the width direction (i.e., the direction indicated by arrow S in FIG. 4).

Further, a guide roller 79 is rotatably provided at the lower end portion of the support shaft 73. The support shaft 73 is inserted so as to contact the lateral guide portion 71*a* via the guide roller 79. As the support shaft 73 moves in the width direction along the lateral guide portion 71*a*, the holder frame 72 and the correction roller pair 31 that is held by the holder frame 72 also move in the width direction. Further, the holder frame 72 also rotates around the support shaft 73 within a plane of sheet conveyance (in the direction indicated by arrow W in FIG. 4). Due to such a configuration, the correction roller pair 31 that is held by the holder frame 72 can be rotated within a plane of sheet conveyance.

As illustrated in FIG. 3, a bracket 69 is provided on the right end side of the body frame 70 and a conveyance drive motor (serving as a conveyance driver) 61 is provided on the bracket 69 to apply a driving force for conveying a sheet, to the drive roller 31*a* (i.e., the correction roller pair 31). The conveyance drive motor 61 and the drive roller 31*a* of the correction roller pair 31 are coupled via a gear train including multiple gears 66 and 67 and a coupling mechanism 65. The coupling mechanism 65 is, for example, a two-step spline coupling. Even if the rotary shaft of the drive roller 31*a* and the rotary shaft of the gear 67 are separated from each other in the axial direction, approached to each other in the axial direction, or are inclined with respect to each other, the coupling mechanism 65 can hold the connection so that the driving force can be transmitted between the drive roller 31*a* and the gear 67. Since the drive roller 31*a* and the gear 67 are coupled via the coupling mechanism 65 as described above, even when the correction roller pair 31 moves in the width direction or rotates within a plane of sheet conveyance, the drive force transmission from the conveyance drive motor 61 to the drive roller 31*a* is preferably performed.

Further, as illustrated in FIG. 3, a rotary encoder 96 is mounted at the end portion of the drive roller 31*a* (i.e., at an end portion on the opposite side from the conveyance drive motor 61). The rotary encoder 96 functions as a conveyance speed detector to detect the conveyance speed of the drive roller 31*a* (i.e., the rotational speed of the conveyance drive motor 61). The conveyance speed of the drive roller 31*a* (i.e., the correction roller pair 31) is controlled based on the detection result of the rotary encoder 96.

Further, the sheet conveying device 7 according to the present embodiment includes a lateral driving mechanism 38 and an angular driving mechanism 39. The lateral driving mechanism 38 causes the holder frame 72 and the correction roller pair 31 to move in the width direction of the sheet P. The angular driving mechanism 39 causes the holder frame 72 and the correction roller pair 31 to rotate within a plane of sheet conveyance.

As illustrated in FIGS. 3 and 4, the lateral driving mechanism 38 includes a lateral drive motor (as a lateral driver) 62, a timing belt 97, a cam 45, and a tension spring 59.

The tension spring 59 is coupled to a position between the holder frame 72 and the base frame 71 so as to bias the holder frame 72 in one direction (i.e., the left direction in FIG. 4) in the width direction. Further, the cam 45 is held by the biasing force of the tension spring 59 in a state where the cam 45 is in contact with a cam follower 46 provided on the support shaft 73. The cam 45 is disposed on the base frame 71 to be rotatable around the rotary shaft 45*a*. As the cam 45 rotates around the rotary shaft 45*a*, the cam follower 46 is pushed by the cam 45. As a result, the holder frame 72 moves in the width direction (i.e., the right direction in FIG. 4).

Further, the cam 45 and the lateral drive motor 62 can drive and transmit the driving force via the timing belt 97 (see FIG. 3). As a result, as the lateral drive motor 62 is driven, the driving force is transmitted from the lateral drive motor 62 to the cam 45 via the timing belt 97 to rotate the cam 45. Further, a rotary encoder 57 (see FIG. 3) is mounted on the rotary shaft 45*a* of the cam 45. The rotary encoder 57 functions as a rotation angle detector to detect the rotation angle (rotation amount) of the cam 45. By controlling the driving of the lateral drive motor 62 based on the detection result of the rotary encoder 57, the rotation angle of the cam 45 is controlled to adjust the amount of movement of the holder frame 72 in the width direction. In other words, the rotary encoder 57 functions as a lateral movement amount detector that detects the amount of movement of the holder frame 72 when the holder frame 72 and the correction roller pair 31 move in the width direction.

As illustrated in FIGS. 3 and 4, the angular driving mechanism 39 includes an angular drive motor (as an angular driver) 63, a timing belt 98, a cam 47, a tension spring 60, and a lever 50.

The tension spring 60 is coupled to the position between the holder frame 72 and the base frame 71 so as to bias the holder frame 72 in one direction (i.e., a clockwise direction around the support shaft 73 in FIG. 4) of the rotational (angular) direction. In addition, the cam 47 is held by the biasing force of the tension spring 60 in a state where the cam 47 is in contact with a cam follower 48 provided at one end of the lever 50. The cam 47 is disposed on the base frame 71 to be rotatable around the rotary shaft 47*a*. As the cam 47 rotates around the rotary shaft 47*a*, the cam follower 48 is pushed by the cam 47. As a result, the lever 50 rotates in the width direction (i.e., the right direction in FIG. 4) around the rotary shaft 50*a*.

An action roller 49 is rotatably provided at an end portion on the opposite side of the lever 50. Accordingly, as the lever 50 rotates (in the counterclockwise direction in FIG. 4) along with the rotation of the cam 47, the action roller 49 pushes the projection 72*a* of the holder frame 72, so that the holder frame 72 rotates in a rotational direction within a plane of sheet conveyance (in the counterclockwise direction in FIG. 4).

Further, the cam 47 and the angular drive motor 63 can drive and transmit the driving force via the timing belt 98 (see FIG. 3). As a result, as the angular drive motor 63 is driven, the driving force is transmitted from the angular drive motor 63 to the cam 47 via the timing belt 98 to rotate the cam 47. Further, a rotary encoder 58 (see FIG. 3) is mounted on the rotary shaft 47*a* of the cam 47. The rotary encoder 58 functions as a rotation angle detector to detect the rotation angle (rotation amount) of the cam 47. By controlling the driving of the angular drive motor 63 based on the detection result of the rotary encoder 58, the rotation angle of the cam 47 is controlled to adjust the number of rotations of the holder frame 72 within a plane of sheet conveyance. In other words, the rotary encoder 58 functions as an angular movement amount detector that detects the amount of movement of the holder frame 72 in the rotational (angular) direction when the holder frame 72 and the correction roller pair 31 rotate within a plane of sheet conveyance.

Figure 5A:
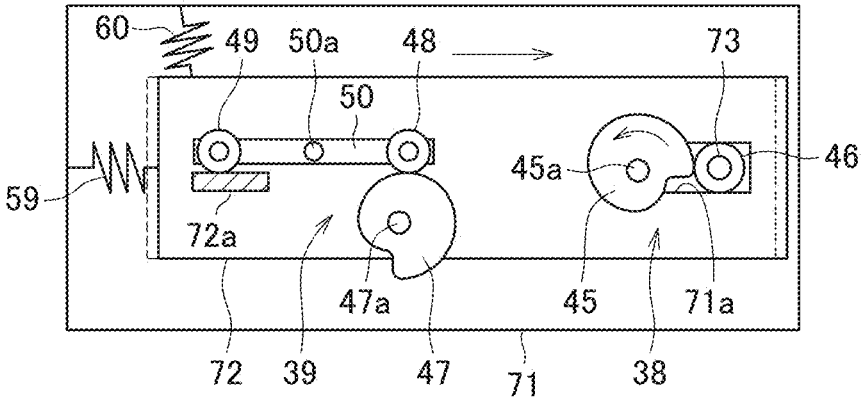
FIG. 5A is a diagram illustrating a state where a support frame moves in the width direction.

FIG. 5A is a diagram illustrating a state where the holder frame 72 moves in the width direction.

Figure 5B:
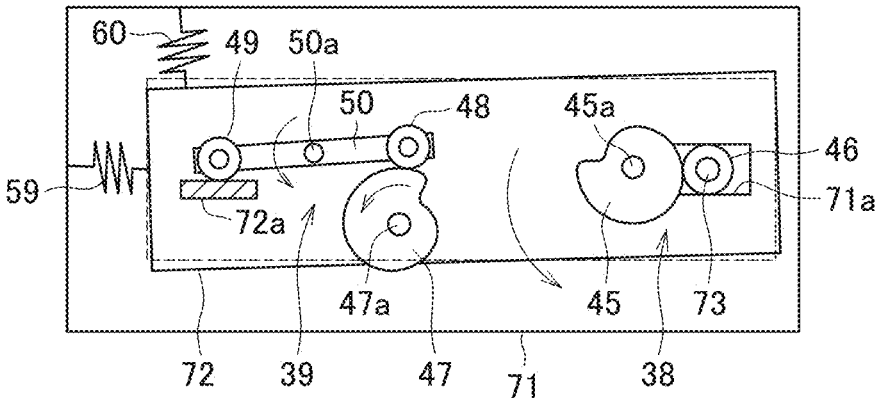
FIG. 5B is a diagram illustrating a state where the support frame moves in the rotational direction within a plane of sheet conveyance.

FIG. 5B is a diagram illustrating a state where the holder frame 72 moves in the rotational direction within a plane of sheet conveyance.

Figure 5C:
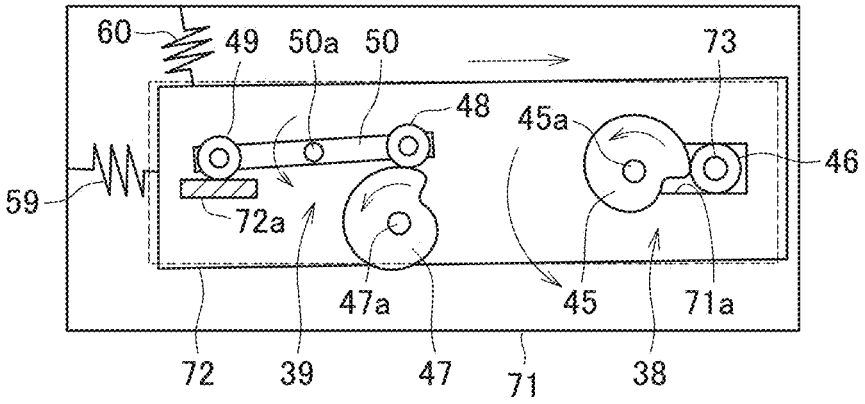
FIG. 5C is a diagram illustrating a state where the support frame moves in the width direction and the rotational direction within a plane of sheet conveyance.

FIG. 5C is a diagram illustrating a state where the holder frame 72 moves in the width direction and the rotational direction within a plane of sheet conveyance.

Specifically, FIG. 5A illustrates the state where the cam 45 of the lateral driving mechanism 38 rotates and the holder frame 72 moves in the width direction (i.e., the right side in FIG. 5A). On the other hand, FIG. 5B illustrates the state where the cam 47 of the angular driving mechanism 39 rotates and the holder frame 72 rotates within a plane of sheet conveyance (i.e., the counterclockwise direction in FIG. 5B). Further, FIG. 5C illustrates the state where both the cam 45 of the lateral driving mechanism 38 and the cam 47 of the angular driving mechanism 39 rotate and the holder frame 72 moves in the width direction (i.e., the right side in FIG. 5C) and rotates within a plane of sheet conveyance (i.e., the counterclockwise direction in FIG. 5C).

As described above, the holder frame 72 at least moves in the width direction or rotates within a plane of sheet conveyance. Due to such a configuration, the correction roller pair 31 held by the holder frame 72 also at least moves in the width direction or rotates within a plane of sheet conveyance.

Figure 6:
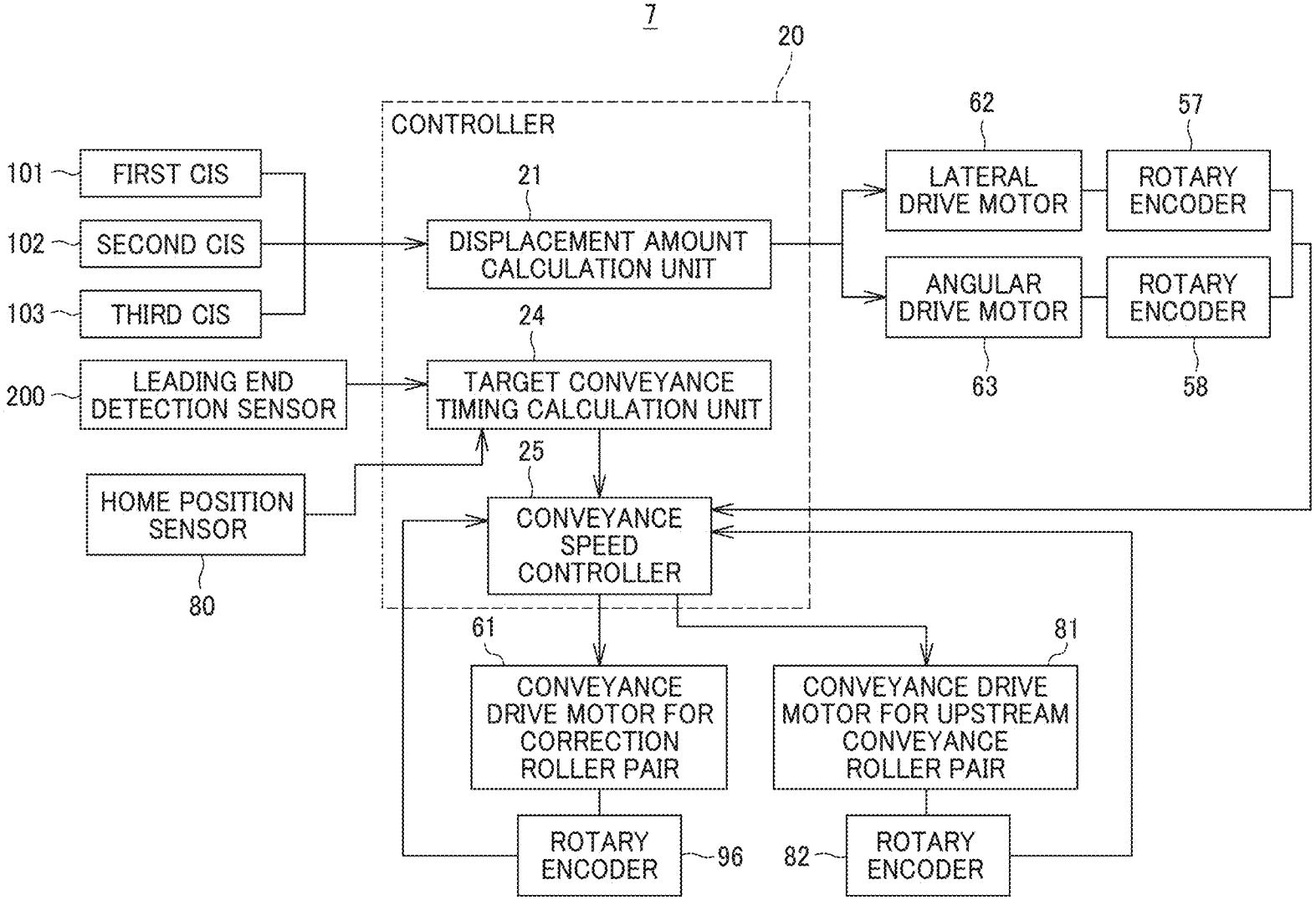
FIG. 6 is a diagram illustrating a configuration of a control system of the sheet conveying device according to an embodiment of the present disclosure.

FIG. 6 is a diagram illustrating a configuration of a control system of the sheet conveying device 7 according to the present embodiment.

As illustrated in FIG. 6, the sheet conveying device 7 according to the present embodiment includes a controller 20 that controls the correction of a displacement of a sheet and the conveyance speed of the sheet. Specifically, the controller 20 includes a displacement amount calculation unit 21, a target conveyance timing calculation unit 24, and a conveyance speed controller 25. The displacement amount calculation unit 21 calculates a displacement amount of the sheet. The target conveyance timing calculation unit 24 calculates the target conveyance timing at which the sheet is conveyed to the first transfer cylinder 8. The conveyance speed controller 25 controls the conveyance speed of the correction roller pair 31 and the upstream conveyance roller pair 44.

The displacement amount calculation unit 21 calculates the displacement amount of the sheet based on the detection results of the first CIS 101, the second CIS 102, and the third CIS 103. The controller 20 controls the correction roller pair 31 based on the displacement amount calculated by the displacement amount calculation unit 21 to correct the displacement of the sheet. In other words, in order to correct the displacement of the sheet, the controller 20 controls the lateral drive motor 62 that drives the correction roller pair 31 to move in the width direction of the sheet, and the angular drive motor 63 that drives the correction roller pair 31 to rotate in the rotational direction of the sheet within a plane of sheet conveyance.

The target conveyance timing calculation unit 24 calculates the target conveyance timing at which the sheet P is conveyed to the first transfer cylinder 8 based on the conveyance position information of the sheet (i.e., the timing at which the gripper 16 on the first transfer cylinder 8 reaches the reference rotation position C) detected by the leading end detection sensor 200 and the rotation position information of the first transfer cylinder 8 detected by a home position sensor 80 (see FIG. 9) that is mounted on the first transfer cylinder 8. In the present embodiment, the gripper 16 (see FIG. 9) serves as a sheet receiver rotatably provided to receive the sheet P on the surface of the first face of the first transfer cylinder 8 that rotates at a constant speed. As the leading end of the sheet P reaches the receiving position A of the gripper 16 (see FIG. 14), the gripper 16 is rotated to carry the sheet P. At this time, in order to convey the sheet P to the gripper 16, the gripper 16 is desired to reach the receiving position A of the gripper 16 (see FIG. 1) in synchronization with arrival of the sheet P to the receiving position A on the gripper 16. In order to achieve the operation, the target conveyance timing in the present embodiment is the timing at which the sheet P reaches the receiving position A simultaneously with the gripper 16. In the present embodiment, a single gripper (i.e., the gripper 16) is disposed on the surface (i.e., the outer circumferential face) of the first transfer cylinder 8 in the configuration of the inkjet image forming apparatus 100 illustrated in FIG. 1. However, the number of the grippers is not limited to one. For example, two or more grippers may be provided on the surface of the first transfer cylinder 8 at equal intervals.

The conveyance speed controller 25 controls the target conveyance timing calculated by the target conveyance timing calculation unit 24 and the conveyance speed of the correction roller pair 31 (i.e., the rotational speed of the conveyance drive motor 61), based on the detection signal of the rotary encoder 96 that detects the conveyance speed of the correction roller pair 31 or each of the detection signal of the rotary encoder 57 that detects the amount of movement of the correction roller pair 31 in the width direction and the detection signal of the rotary encoders 58 that detects the amount of rotations of the correction roller pair 31 within a plane of sheet conveyance. The conveyance speed controller 25 also controls the conveyance speed of the upstream conveyance roller pair 44 (i.e., the rotational speed of the conveyance drive motor 81). As in the correction roller pair 31, the upstream conveyance roller pair 44 is provided with a rotary encoder 82 (see FIG. 2) serving as a conveyance speed detector to detect the conveyance speed (i.e., the rotational speed of the conveyance drive motor 81). The conveyance speed of the upstream conveyance roller pair 44 is controlled by the conveyance speed controller 25 based on a detection signal of the rotary encoder 82.

Figure 7:
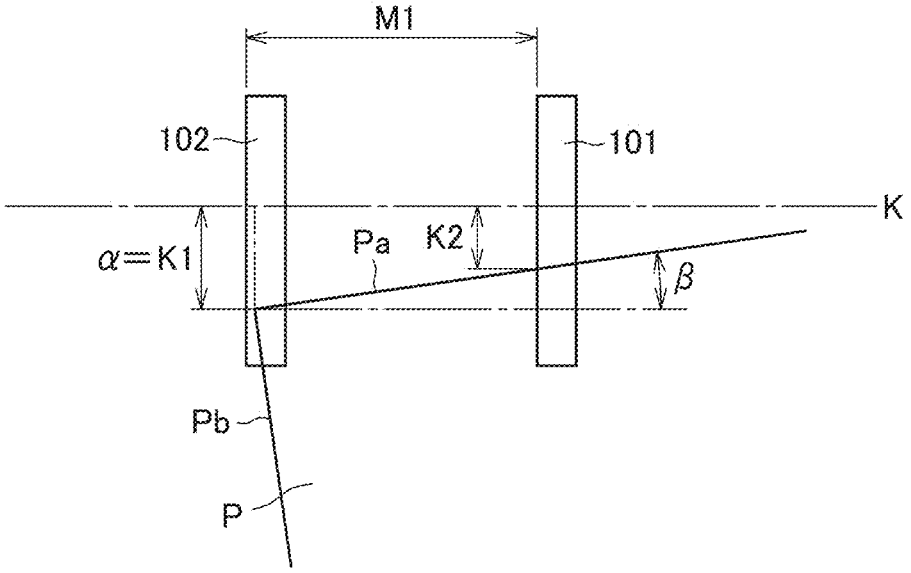
FIG. 7 is a diagram illustrating the sheet conveying device executing a method of calculating a displacement amount of a sheet, according to an embodiment of the present disclosure.
Figure 8:
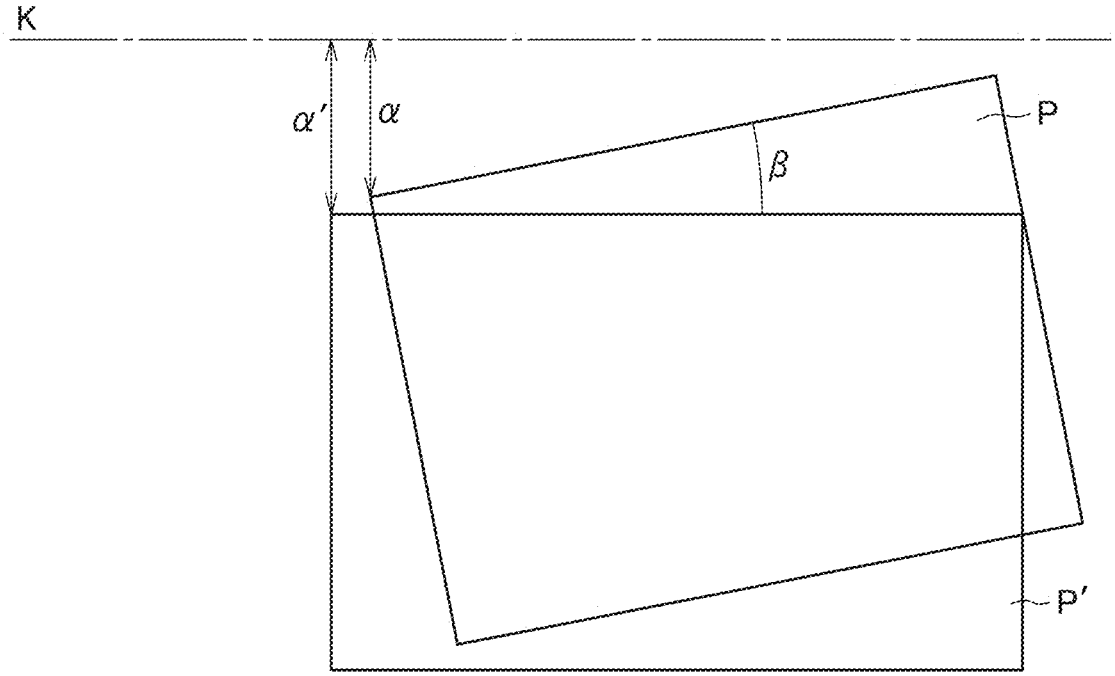
FIG. 8 is a diagram illustrating the sheet conveying device executing another method of calculating a displacement amount of a sheet, according to an embodiment of the present disclosure.

A description is now given of a method of calculating the displacement amount of a sheet based on the detection results of the first CIS 101, the second CIS 102, and the third CIS 103, with reference to FIGS. 7 and 8.

FIG. 7 is a diagram illustrating the sheet conveying device 7 executing a method of calculating the displacement amount of a sheet, according to an embodiment of the present disclosure.

FIG. 8 is a diagram illustrating the sheet conveying device 7 executing another method of calculating the displacement amount of a sheet, according to an embodiment of the present disclosure.

As illustrated in FIG. 7, when the leading end Pb of the sheet P passes the first CIS 101 and reaches the second CIS 102, the lateral displacement amount $\alpha$ of the sheet P and the angular displacement amount $\beta$ of the sheet P are detected.

Specifically, the lateral displacement amount $\alpha$ of the sheet P is calculated based on a position of the sheet P in the width direction of the sheet P detected by the second CIS 102 (i.e., a position of the side end Pa of the sheet P). In other words, the position in the width direction of the sheet P detected by the second CIS 102 is compared with the conveyance reference position K. Consequently, a distance K1 extending between the position of the sheet P in the width direction and the reference conveyance position K is calculated as a lateral displacement amount $\alpha$ of the sheet P.

Further, the angular displacement amount $\beta$ of the sheet P is calculated based on a difference of end positions in the width direction of the sheet P detected by the first CIS 101 and the second CIS 102. In other words, as illustrated in FIG. 7, when the leading end Pb of the sheet P reaches the second CIS 102, the distance K1 and a distance K2 in the width direction from the reference conveyance position K are detected by the first CIS 101 and the second CIS 102, respectively. Consequently, since a distance M1 in the sheet conveying direction between the first CIS 101 and the second CIS 102 is determined in advance, the angular displacement amount β to the sheet conveying direction of the sheet P is obtained based on an equation of tan β=(K1−K2)/M1.

As described above, the lateral displacement amount α of the sheet P and the angular displacement amount β of the sheet P are calculated. As described above, the lateral displacement amount α of the sheet P and the angular displacement amount β of the sheet P can be calculated based on the detection results of the first CIS 101 and the second CIS 102. Alternatively, the lateral displacement amount α of the sheet P and the angular displacement amount β of the sheet P may be calculated based on the detection results of the second CIS 102 and the third CIS 103. The method of calculating the lateral displacement amount α of the sheet P and the angular displacement amount β of the sheet P based on the detection results of the second CIS 102 and the third CIS 103 is same as the above-described method of calculating the lateral displacement amount α of the sheet P and the angular displacement amount β of the sheet P based on the detection results of the first CIS 101 and the second CIS 102. As illustrated in FIG. 8, as the position of the sheet P changes to a sheet P' due to correction of the angular displacement β, the lateral displacement amount α of the sheet P changes to a lateral displacement amount α' of the sheet P'. Accordingly, by calculating the lateral displacement amount α' of the sheet P' in advance, the lateral displacement α of the sheet P is corrected with higher accuracy.

Figure 13A:
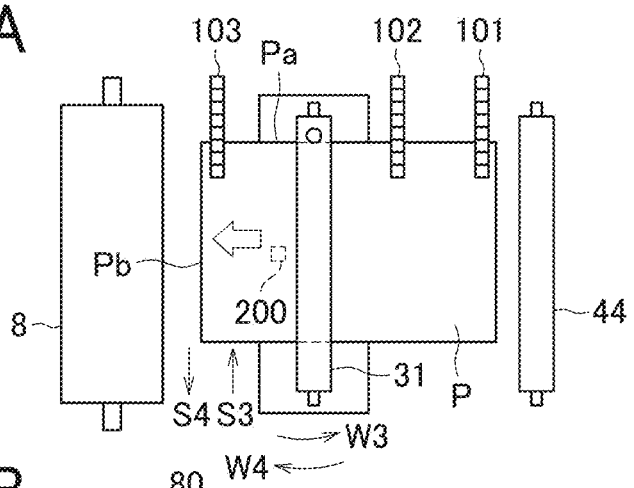
FIG. 13A is a plan view of the sheet conveying device during a subsequent operation, according to an embodiment of the present disclosure.
Figure 13B:
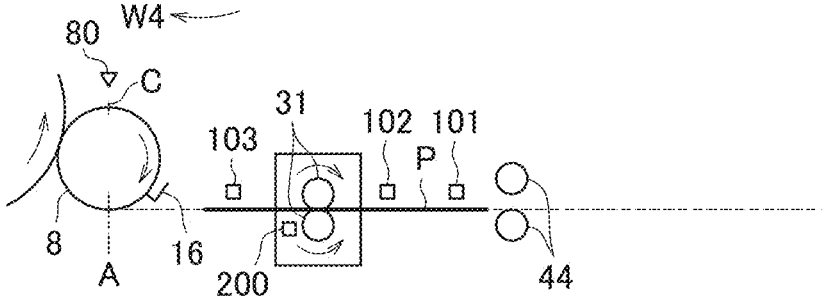
FIG. 13B is a side view of the sheet conveying device of FIG. 13A.
Figure 14A:
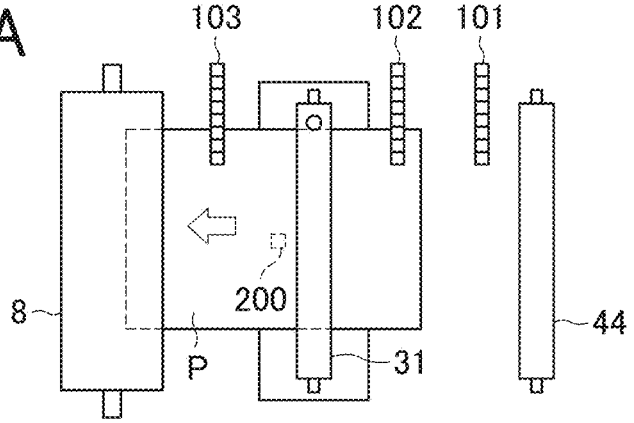
FIG. 14A is a plan view of the sheet conveying device during a subsequent operation, according to an embodiment of the present disclosure.
Figure 14B:
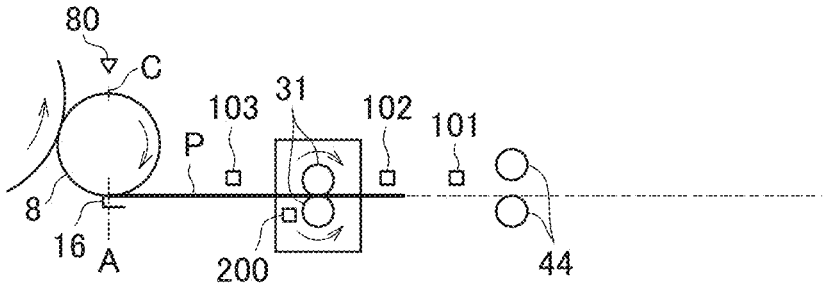
FIG. 14B is a side view of the sheet conveying device of FIG. 14A.
Figure 15:
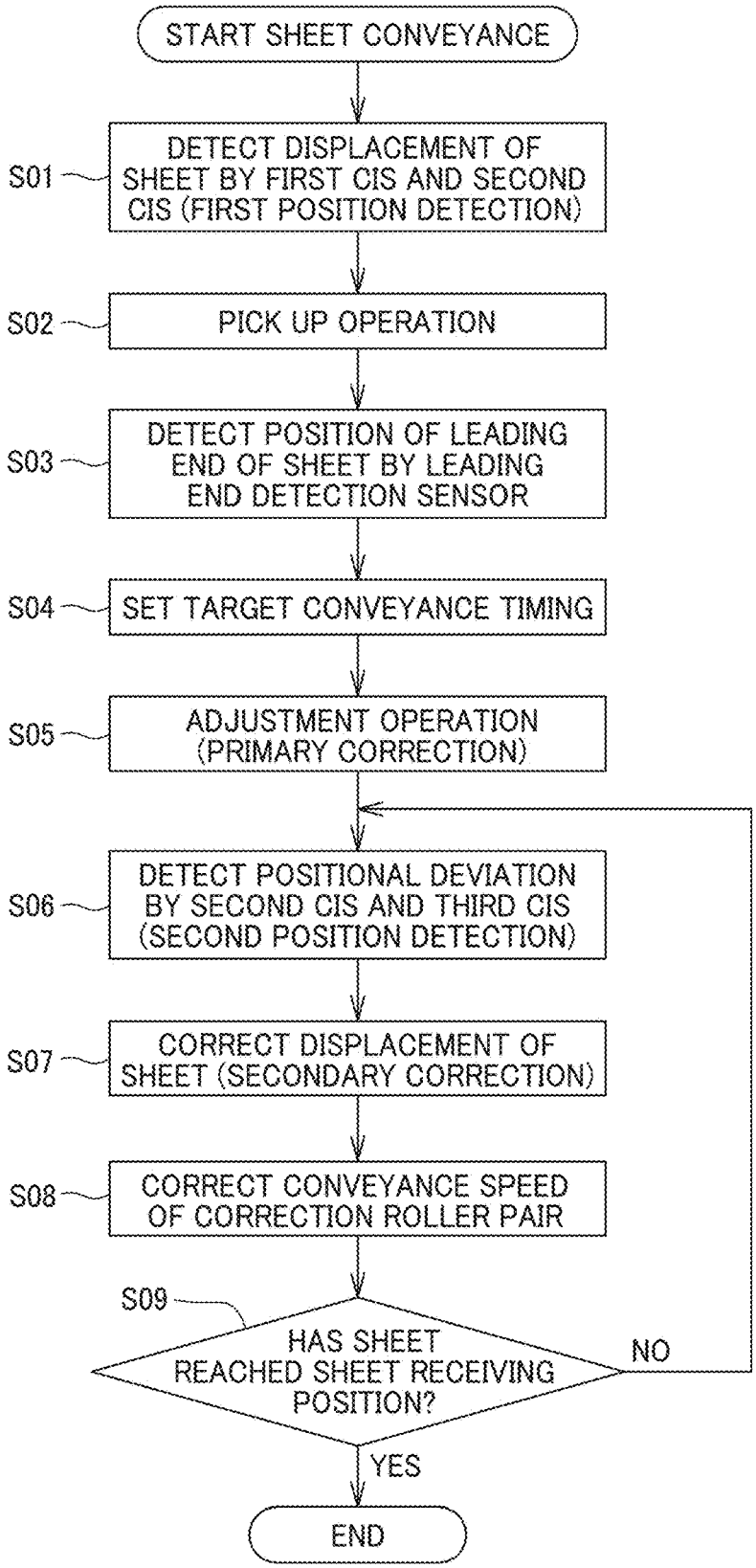
FIG. 15 is a flowchart of a sheet conveying operation performed in the sheet conveying device according to an embodiment of the present embodiment.

A description is now given of an operation of the sheet conveying device 7 according to the present embodiment, with reference to FIGS. 9A to 14B and a flowchart of FIG. 15.

Figure 9A:
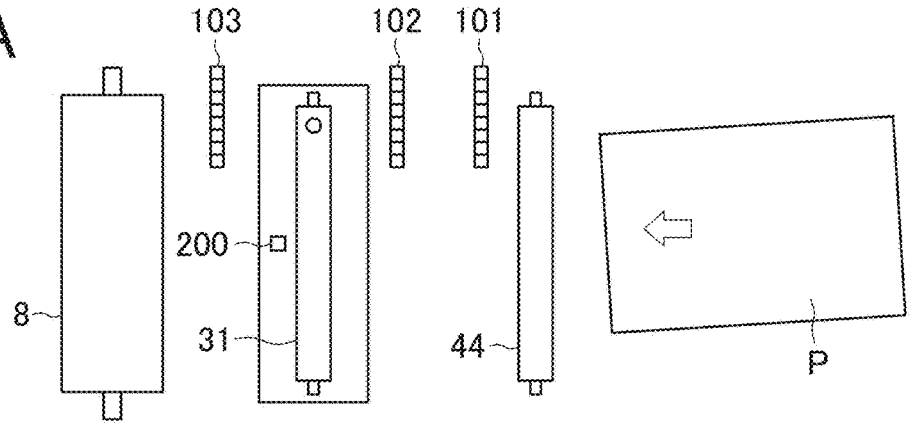
FIG. 9A is a plan view of the sheet conveying device during an operation, according to an embodiment of the present disclosure.

FIG. 9A is a plan view of the sheet conveying device 7 during an operation, according to the present embodiment.

Figure 9B:
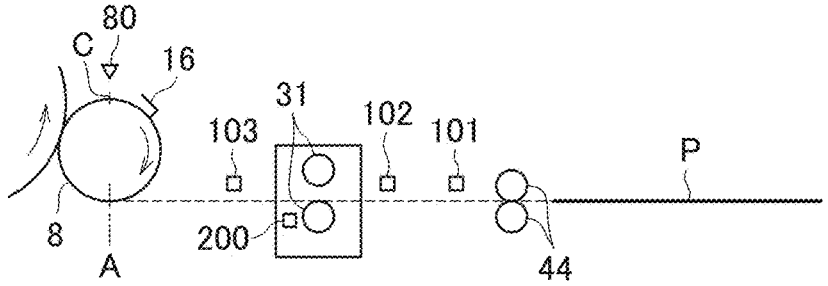
FIG. 9B is a side view of the sheet conveying device of FIG. 9A.

FIG. 9B is a side view of the sheet conveying device 7 of FIG. 9A.

At this time, the correction roller pair 31 is disposed at a reference position so that the roller shaft is perpendicular to the sheet conveyance direction. Further, at the reference position, the rollers of the correction roller pair 31 remains in a stationary state and are separated from each other.

Figure 10A:
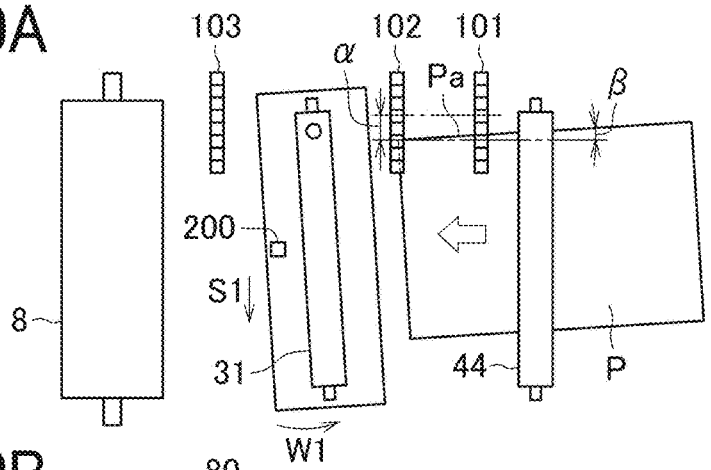
FIG. 10A is a plan view of the sheet conveying device during a subsequent operation, according to an embodiment of the present disclosure.

FIG. 10A is a plan view of the sheet conveying device 7 during a subsequent operation, according to the present embodiment.

Figure 10B:
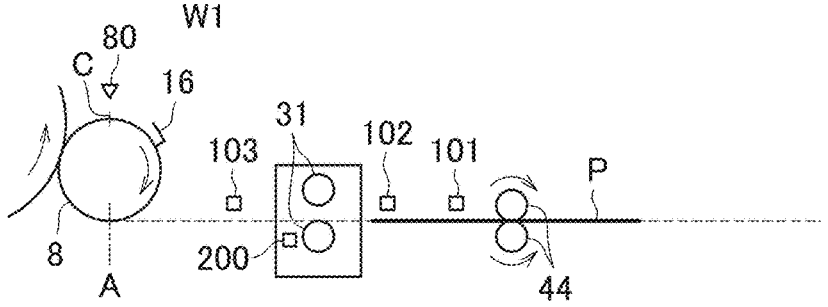
FIG. 10B is a side view of the sheet conveying device of FIG. 10A.

FIG. 10B is a side view of the sheet conveying device 7 of FIG. 10A.

As illustrated in FIGS. 10A and 10B, when the leading end Pb of the sheet P passes by the first CIS 101 and reaches the second CIS 102, the first CIS 101 and the second CIS 102 detects the respective positions of the side end Pa of the sheet P (step S01 in the flowchart of FIG. 15). In the following descriptions, this detection is referred to as a "first position detection." Then, the displacement amount calculation unit 21 (see FIG. 6) calculates the lateral displacement amount α (or the lateral displacement amount α' together with the angular displacement amount β) and the angular displacement amount β based on the position information detected by the first position detection.

Then, based on the calculated displacement amount of the sheet, the lateral drive motor 62 and the angular drive motor 63 are controlled to move the correction roller pair 31 in the width direction (i.e., in the direction indicated by arrow S1 in FIG. 10A) and rotate in the rotational direction within a plane of sheet conveyance (i.e., in the direction indicated by arrow W1 in FIG. 10A). As a result, the correction roller pair 31 performs the pick-up and hold operation in which the correction roller pair 31 moves to face the leading end Pb of the sheet P (step S02 in the flowchart of FIG. 15).

Figure 11A:
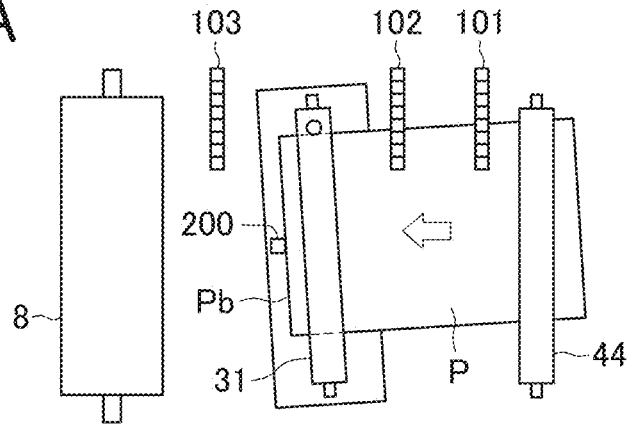
FIG. 11A is a plan view of the sheet conveying device during a subsequent operation, according to an embodiment of the present disclosure.

FIG. 11A is a plan view of the sheet conveying device 7 during a subsequent operation, according to the present embodiment.

Figure 11B:
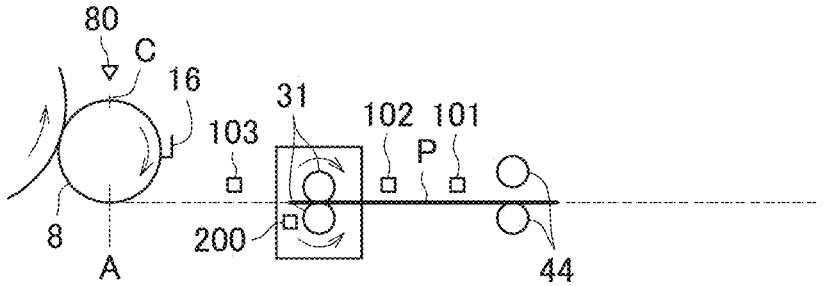
FIG. 11B is a side view of the sheet conveying device of FIG. 11A.

FIG. 11B is a side view of the sheet conveying device 7 of FIG. 11A.

After the operation in step S02, as the rollers of the correction roller pair 31 contact at a given timing and start rotating, the sheet P is picked up by the correction roller pair 31 that faces the sheet P and is held by the correction roller pair 31, as illustrated in FIGS. 11A and 11B. On the other hand, the rollers of the upstream conveyance roller pair 44 are separated from each other.

As illustrated in FIGS. 11A and 11B, when the leading end Pb of the sheet P reaches the position of the leading end detection sensor 200, the leading end Pb of the sheet P is detected by the leading end detection sensor 200 (step S03 in the flowchart of FIG. 15). Further, the home position sensor 80 of the first transfer cylinder 8 detects in advance the timing at which the gripper 16 of the first transfer cylinder 8 reaches the reference rotation position C. The target conveyance timing of the sheet P is calculated based on the detection information of the home position sensor 80 and the detection information of the leading end detection sensor 200 (i.e., the timing at which the leading end Pb of the sheet P reaches the leading end detection sensor 200). The target conveyance timing is calculated by the target conveyance timing calculation unit 24 (see FIG. 6), and the calculated timing is set as a target conveyance timing of the sheet P that reaches the receiving position A (step S04 in the flowchart of FIG. 15).

Figure 12A:
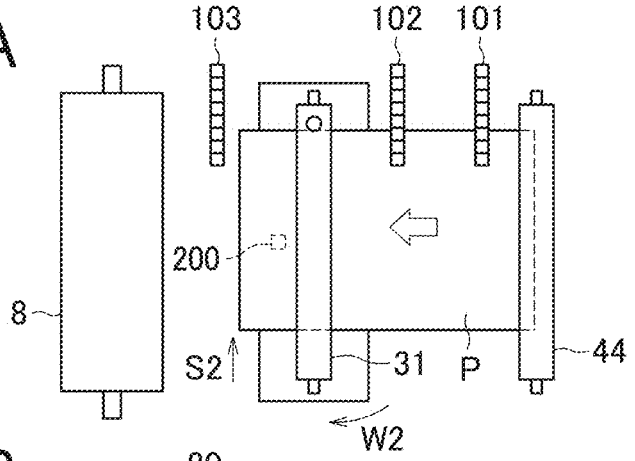
FIG. 12A is a plan view of the sheet conveying device during a subsequent operation, according to an embodiment of the present disclosure.

FIG. 12A is a plan view of the sheet conveying device 7 during a subsequent operation, according to the present embodiment.

Figure 12B:
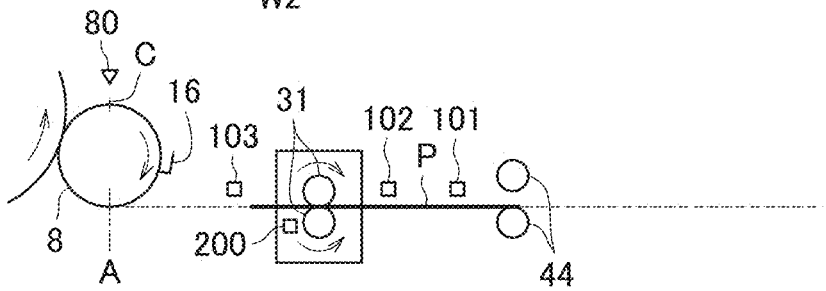
FIG. 12B is a side view of the sheet conveying device of FIG. 12A.

FIG. 12B is a side view of the sheet conveying device 7 of FIG. 12A.

After the operation in step S04, as illustrated in FIGS. 12A and 12B, while gripping and conveying the sheet P, the correction roller pair 31 performs an adjustment operation to move in a direction opposite to the direction in which the correction roller pair 31 moves in the pick-up and hold operation (i.e., the direction indicated by arrow S2, and the direction indicated by arrow W2 in FIG. 12A) (step S05 in the flowchart of FIG. 15). As a result, the lateral displacement of the sheet P and the angular displacement of the sheet P are corrected. In the following descriptions, this correction is referred to as a "primary correction." In the flowchart of FIG. 15, the adjustment operation (i.e., the primary correction) performed by the correction roller pair 31 in step S05 is described in the order after detection of the position of the leading end Pb of the sheet P detected by the leading end detection sensor 200 in step S03. However, the adjustment operation (step S05) may be started before the detection of the position of the leading end Pb of the sheet P detected by the leading end detection sensor 200 (step S03) immediately after the pick-up operation (step S02).

Further, FIG. 13A is a plan view of the sheet conveying device 7 during a subsequent operation, according to the present embodiment.

FIG. 13B is a side view of the sheet conveying device 7 of FIG. 13A.

As the sheet P is conveyed further downstream and, as illustrated in FIGS. 13A and 13B, when the leading end Pb of the sheet P reaches the third CIS 103, the second CIS 102 and the third CIS 103 detect the respective positions of the side end Pa of the sheet P again (step S06 in the flowchart of FIG. 15). In the following descriptions, this detection is referred to as a "second position detection." Based on the position information detected in the second position detection, the angular and lateral displacement amounts of the sheet P are calculated by the displacement amount calculation unit 21.

Then, based on the calculated amounts of angular and lateral displacements of the sheet P, the lateral drive motor 62 is controlled to move the correction roller pair 31 in the width direction (i.e., in a direction indicated by arrow S3 or in a direction indicated by arrow S4 in FIG. 13A) and the angular drive motor 63 is controlled to rotate the correction roller pair 31 in the rotation direction within a plane of sheet conveyance (i.e., in a direction indicated by arrow W3 or in a direction indicated by arrow W4 in FIG. 13A). By so doing, the displacement of the sheet P is corrected (step S07 in the flowchart of FIG. 15). In the following descriptions, this correction is referred to as a "secondary correction."

As described above, by detecting the angular and lateral displacements of the sheet P (i.e., the second position detection) even after the adjustment and feed operation (i.e., the primary correction) and correcting the angular and lateral displacements of the sheet P based on the detection results (i.e., the secondary correction), the angular and lateral displacements of the sheet P that are generated while the sheet P is being conveyed by the correction roller pair 31 can be eliminated. Further, detection of the angular and lateral displacements of the sheet P after completion of the adjustment and feed operation (i.e., the second position detection) may be performed multiple times at predetermined intervals during a period that the sheet P is passing by the second CIS 102 and the third CIS 103. Accordingly, by performing the detection of the angular and lateral displacements of a sheet (i.e., the second position detection) for multiple times by the time that the sheet P reaches the receiving position A of the first transfer cylinder 8 and by performing the correction of the angular and lateral displacements (i.e., the secondary correction) each time the above-described detection is performed (i.e., steps S06 to S09 in the flowchart of FIG. 15), the sheet is conveyed with higher accuracy.

FIG. 14A is a plan view of the sheet conveying device 7 during a subsequent operation, according to the present embodiment.

FIG. 14B is a side view of the sheet conveying device 7 of FIG. 14A.

FIG. 15 is a flowchart of a sheet conveying operation performed in the sheet conveying device 7 according to an embodiment of the present embodiment.

As illustrated in FIGS. 14A and 14B, it is determined whether the sheet P is further conveyed to the receiving position A in synchrony with the timing at which the gripper 16 of the first transfer cylinder 8 reaches the receiving position A. In other words, it is determined whether the sheet P reaches the receiving position A (step S09 in the flowchart of FIG. 15). When the sheet P has not reached the receiving position A (NO in step S09), steps S06 to S09 are repeated until the sheet P reaches the receiving position A. On the other hand, when the sheet P reaches the receiving position A (YES in step S09), the sheet conveyance ends.

However, in a case where the secondary correction as described above is performed after the setting of the target conveyance timing of the sheet P, the position of the sheet in the sheet conveying direction changes along with the secondary correction. For this reason, in a case where the sheet whose position in the sheet conveyance direction is changed is conveyed at the same conveyance speed, the timing at which the sheet P reaches the receiving position A and the timing at which the gripper 16 of the first transfer cylinder 8 reaches the receiving position A also changes. In such a case, it is likely that the gripper 16 cannot grip the sheet P accurately.

In order to avoid this inconvenience, in the present embodiment, each time the correction of the angular and lateral displacements of the sheet P is performed after the secondary correction, the conveyance speed of the correction roller pair 31 is changed (adjusted) based on the amount of correction of the angular and lateral displacements of the sheet P (step S08 in the flowchart of FIG. 15). As described above, by changing the conveyance speed of the correction roller pair 31, the sheet P can be conveyed accurately to the receiving position A in synchrony with arrival of the gripper 16 at the receiving position A (step S09 in the flowchart of FIG. 15). Accordingly, the gripper 16 receives (grips) the sheet P successfully.

When the secondary correction is performed, the conveyance speed of the correction roller pair 31 is controlled as described below.

Figure 16:
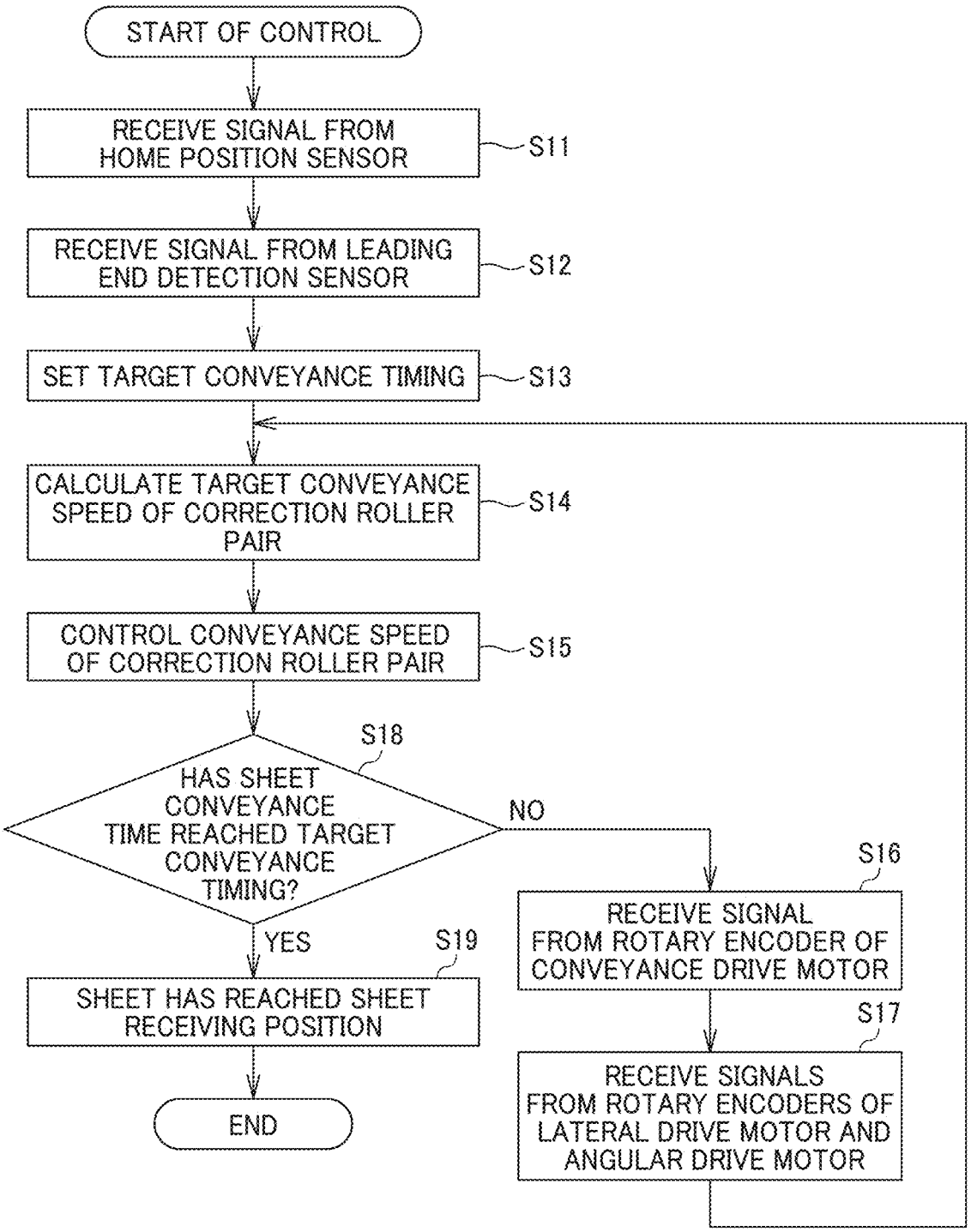
FIG. 16 is a flowchart of the control of the conveyance speed.

FIG. 16 is a flowchart of the control of the conveyance speed of the correction roller pair 31.

As described in the flowchart of FIG. 16, it is confirmed that the gripper 16 is at the reference rotation position C based on the detection information of the home position sensor 80 of the first transfer cylinder 8. In other words, a signal sent from the home position sensor 80 is received (step S11 in the flowchart of FIG. 16). Then, the leading end detection sensor 200 detects the leading end of the sheet P, in other words, a signal sent from the leading end detection sensor 200 is received (step S12 in the flowchart of FIG. 16). Then, the target conveyance timing is set based on the detection information of the leading end detection sensor 200 and the detection information of the home position sensor 80 (step S13 in the flowchart of FIG. 16).

Then, the target conveyance speed of the correction roller pair 31 is calculated in accordance with the set target conveyance timing (step S14 in the flowchart of FIG. 16). The calculation of the target conveyance speed of the correction roller pair 31 may be performed by the target conveyance timing calculation unit 24 (see FIG. 6) or any other calculation unit. Then, the conveyance speed of the correction roller pair 31 is controlled based on the calculated target conveyance speed of the correction roller pair 31 (step S15 in the flowchart of FIG. 16).

After step S15, it is determined whether the sheet conveyance time reaches the target conveyance timing (step S18 in the flowchart of FIG. 16). When the sheet conveyance time has not reached the target conveyance timing (NO in step S18), the conveyance speed of the correction roller pair 31 is managed based on a signal from the rotary encoder 96 (see FIG. 6) mounted on the correction roller pair 31 until the sheet conveyance time reaches the target conveyance timing. In other words, the conveyance speed controller 25 (see FIG. 6) receives the signal from the rotary encoder 96 (step S16 in the flowchart of FIG. 16). When the conveyance speed of the correction roller pair 31 is faster than the target conveyance speed, the conveyance speed controller 25 decreases the conveyance speed. By contrast, when the conveyance speed of the correction roller pair 31 is slower than the target conveyance speed, the conveyance speed controller 25 increases the conveyance speed.

Further, if the secondary correction is performed before the sheet conveyance time reaches the target conveyance timing, the conveyance speed of the correction roller pair 31 is changed based on the correction amount of the secondary correction. The correction amount in the secondary correction corresponds to the amount of movement of the correction roller pair 31 in the width direction and the amount of movement of the correction roller pair 31 within a plane of sheet conveyance in the rotational direction in the secondary correction. For this reason, in the present embodiment, the conveyance speed controller 25 receives the signal from the rotary encoder 57 (see FIG. 6) that detects the amount of movement of the correction roller pair 31 in the width direction and the signal from the rotary encoder 58 (see FIG. 6) that detects the amount of movement of the correction roller pair 31 within a plane of sheet conveyance in the rotational direction (step S17 in the flowchart of FIG. 16), and the conveyance speed controller 25 controls the conveyance speed of the sheet P. More specifically, the target conveyance speed of the correction roller pair 31 is calculated again based on the signals from the rotary encoders 57 and 58 and the signal from the rotary encoder 96 that manages the conveyance speed of the correction roller pair 31 (step S14 in the flowchart of FIG. 16). Then, the conveyance speed of the correction roller pair 31 is controlled based on the calculated target conveyance speed (step S15 in the flowchart of FIG. 16). Then, such the control of the conveyance speed of the correction roller pair 31 continues until the sheet conveyance time reaches the target conveyance timing of the first transfer cylinder 8 (step S18 in the flowchart of FIG. 16).

When the sheet conveyance time reaches the target conveyance timing (YES in step S18 in the flowchart of FIG. 16), the sheet P reaches the receiving position A (step S19 in the flowchart of FIG. 16). As a result, the sheet P is gripped by the gripper 16.

As described above, the sheet conveying device according to the present embodiment corrects the lateral and angular displacements of the sheet while the sheet is being conveyed by the correction roller pair 31. By so doing, the sheet conveying device can correct the lateral and angular displacements of the sheet P without deteriorating the productivity. Further, the sheet conveying device according to the present embodiment can eliminate the deviation of the sheet conveyance timing associated with the second correction by adjusting the conveyance speed of the correction roller pair 31. Accordingly, the sheet can be conveyed to the target position with high accuracy. Further, when the duplex printing is performed, the sheet can be conveyed to the image forming device 2 with good accuracy in the case where an image is formed on the front face of the sheet and the case where an image is formed on the back face of the sheet. Accordingly, the relative displacement of the image on the front face of the sheet and the image on the back face of the sheet can also be removed.

In such a sheet conveying device, when the conveyance speed of the correction roller pair 31 is increased for further enhancement in the productivity, or when the conveyance distance from the correction roller pair 31 to the first transfer cylinder 8 is shortened for a decrease in size, the time during which the sheet is conveyed by the correction roller pair 31 is shortened. For this reason, the time during which the displacement of a sheet can be corrected by the correction roller pair 31 is also shortened. In this case, it is difficult to sufficiently obtain the time for correcting the displacement on the sheet. For this reason, it is likely that the correction accuracy is lowered.

In order to address this inconvenience, the sheet conveying device according to the present disclosure employs the configuration described below, so as to obtain a relatively long time for correcting the displacement of the sheet. Now, a description is given of the sheet conveying device 7 according to the above-described embodiment of the present disclosure.

Figure 17:
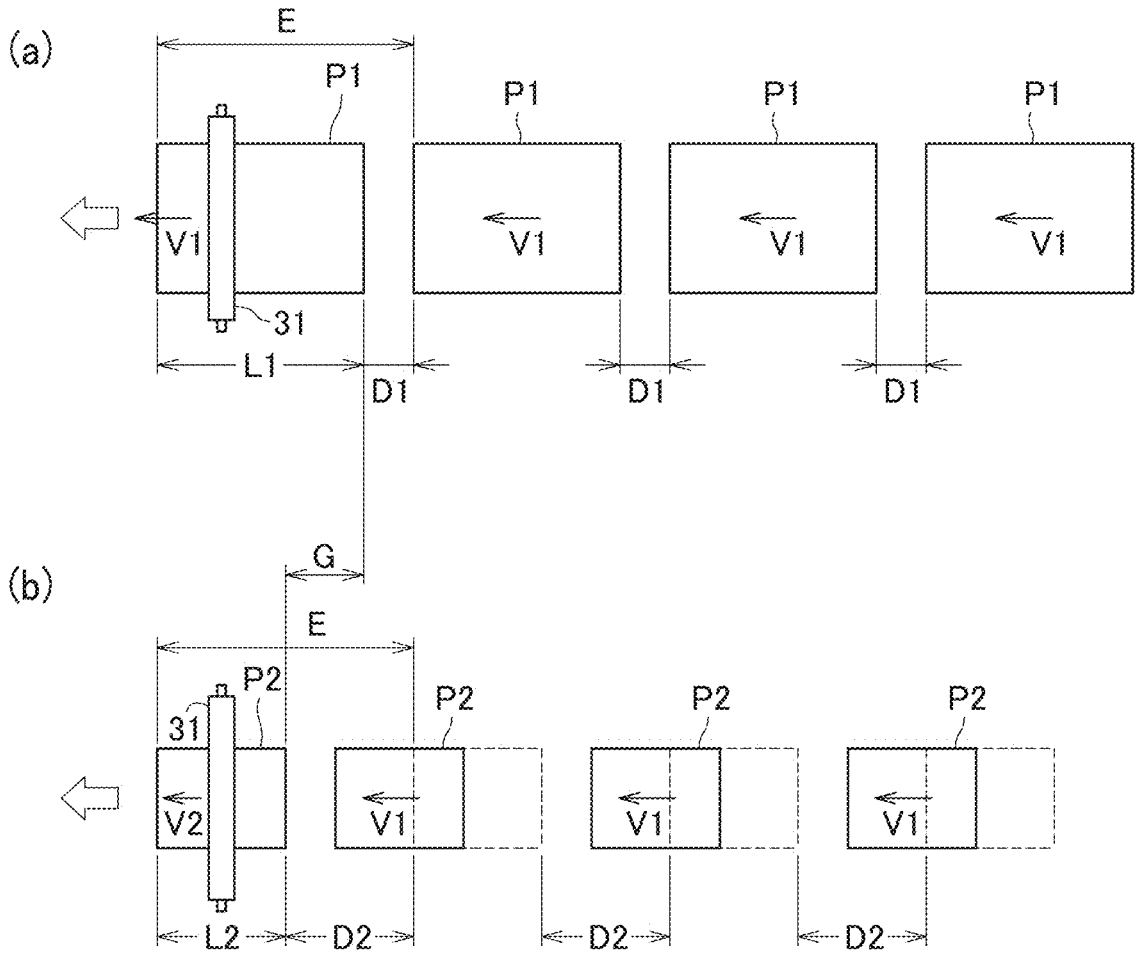
FIG. 17 including FIGS. 17(*a*) and 17(*b*), where FIG. 17(*a*) is a plan view of the sheet conveying device according to an embodiment of the present embodiment, in a state where multiple large-size sheets are continuously conveyed and FIG. 17(*b*) is a plan view of the sheet conveying device according to an embodiment of the present embodiment, in a state where multiple small-size sheets are continuously conveyed.

FIG. 17 including FIGS. 17(*a*) and 17(*b*) is a plan view of the sheet conveying device 7 according to the present embodiment, in a state where multiple large-size papers (multiple large-size sheets) and multiple small-size papers (multiple small-size sheets) are continuously conveyed.

FIG. 17(*a*) illustrates the state where multiple large-size sheets P1 having a length L1 that is relatively long in the sheet conveyance direction are continuously conveyed.

FIG. 17(*b*) illustrates the state where multiple small-size sheets P2 having a length L2 that is relatively short in the sheet conveyance direction are continuously conveyed.

The operation in which multiple sheets are continuously conveyed is referred to as a "continuous sheet conveyance" indicating a conveying operation in which conveyance of subsequent sheets is started at constant intervals while a preceding sheet is being conveyed.

As illustrated in FIGS. 17(*a*) and 17(*b*) of FIG. 17, in the present embodiment, no matter when the large-size sheets P1 or the small-size sheets P2 are conveyed, conveyance of sheets is started equally at the conveyance speed V1. In the case of the large-size sheet P1, after the large-size sheet P1 is conveyed to the correction roller pair 31, the conveyance speed of the large-size sheet P1 on which the secondary correction is performed is finely adjusted. Otherwise, the large-size sheet P1 is basically conveyed at the conveyance speed V1. By contrast, in the case of the small-size sheet P2, when the conveyance of the small-size sheet P2 is started, the conveyance speed of the small-size sheet P2 is reduced from the conveyance speed V1 to the conveyance speed V2, which is different from the case of the large-size sheet P1. Accordingly, the small-size sheet P2 is conveyed by the correction roller pair 31 at the conveyance speed V2 that is slower than the conveyance speed V1. As described above, when the small-size sheets P2 are continuously conveyed, the small-size sheets P2 are conveyed by the correction roller pair 31 at the conveyance speed V2 that is slower than the conveyance speed V1. Due to such a configuration, a longer time for correcting the displacement of a sheet by the correction roller pair 31 can be obtained.

In a configuration in which the gripper 16 on the first transfer cylinder 8 reaches the receiving position A for receiving the sheet at a constant timing (i.e., at the equal timing) as in the sheet conveying device according to the present embodiment, the sheet is to be conveyed to the receiving position A in accordance in synchrony with the arrival timing of the gripper 16 even when conveying a large-size sheet P1 or a small-size sheet P2. Accordingly, when the conveyance of sheets is started at the conveyance speed V1 regardless of the sheet size, the leading end of a large-size sheet P1 and the leading end of a small-size sheet P2 are normally conveyed toward the correction roller pair 31 at substantially the same timing, as illustrated with the solid line in FIG. 17(*a*) and the broken line in FIG. 17(*b*). In other words, when continuously conveying multiple sheets regardless of large-size sheets P1 or small-size sheets P2, a distance E between the leading end of a preceding sheet and the leading end of a subsequent sheet following the preceding sheet is set to an equal distance.

However, in this case, the interval (i.e., the sheet interval) from the trailing end of the preceding sheet to the leading end of the subsequent sheet is greater in the small-size sheet P2 than in the large-size sheet P1 (i.e., D2>D1). In the first place, the sheet interval is given to avoid contact between the preceding sheet and the subsequent. For this reason, in this case, the sheet interval D2 for the small-size sheet is given to be greater than needed.

The present disclosure is focused on the fact that the sheet interval D2 of the small-size sheet P2 is given to be greater than needed, and the conveyance speed of the preceding sheet is reduced by using the size of the sheet interval D2. In other words, in the case of the small-size sheet P2, the sheet interval D2 is given to be greater. Due to such a configuration, even if the conveyance speed of the preceding sheet is reduced, the contact between the preceding sheet and the subsequent sheet can be avoided.

A description is now given of the conveying operation performed in the sheet conveying device according to the present embodiment when a small-size sheet P2 is conveyed.

Figure 18:
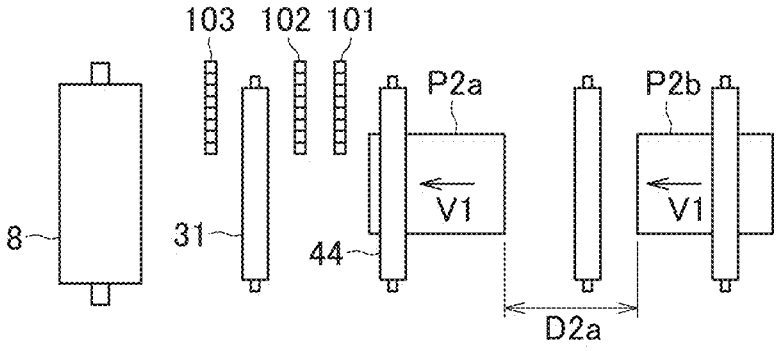
FIG. 18 is a plan view of the sheet conveying device according to an embodiment of the present embodiment, in a state where a first small-size sheet of multiple small-size sheets is conveyed to a correction roller pair in continuous sheet conveyance.

FIG. 18 is a plan view of the sheet conveying device 7 according to the present embodiment, in a state where the first small-size sheet P2*a* is conveyed to the correction roller pair 31 in continuous conveyance.

As illustrated in FIG. 18, the first small-size sheet P2*a* and the subsequent small-size sheets are conveyed by the upstream conveyance roller pair 44 to the correction roller pair 31 at the given conveyance speed V1.

Figure 19:
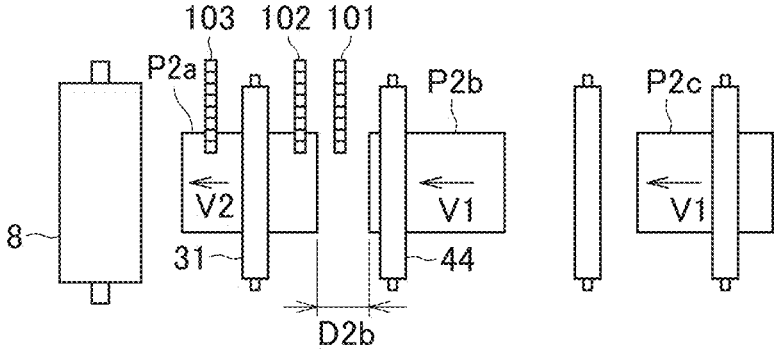
FIG. 19 is a plan view of the sheet conveying device according to an embodiment of the present embodiment, in a state where the first small-size sheet reaches the correction roller pair and where the correction roller pair conveys the first small-size sheet of the multiple small-size sheets.

FIG. 19 is a plan view of the sheet conveying device 7 according to the present embodiment, in a state where the first small-size sheet P2*a* reaches the correction roller pair 31 and where the correction roller pair 31 conveys the first small-size sheet P1*a*.

As illustrated in FIG. 19, in the state where the first small-size sheet P2*a* is conveyed by the correction roller pair 31, the conveyance speed of the small-size sheet P2*a* is reduced from the conveyance speed V1 to the conveyance speed V2. As described above, when multiple small-size sheets are consecutively conveyed, the conveyance speed of the small-size sheet P2*a* is reduced so that the correction roller pair 31 conveys the small-size sheet P2*a* at the reduced conveyance speed V2 that is slower than the conveyance speed V1. By so doing, the time for correcting the displacement of the sheet by the correction roller pair 31 can be longer.

As the conveyance speed of the first small-size sheet P2*a* is reduced, the second small-size sheet P2*b* subsequent to the first small-size sheet P2*a* approaches the first small-size sheet P2*a*. For this reason, in response to the reduction of the conveyance speed of the first small-size sheet P2*a*, the sheet interval between the first small-size sheet P2*a* and the second small-size sheet P2*b* is reduced. In other words, at the time when the conveyance speed of the first small-size sheet P2*a* is reduced, the second small-size sheet P2*b* is being conveyed at the conveyance speed V1 that is the conveyance speed faster than the reduced conveyance speed. For this reason, in response to the reduction of the conveyance speed of the first small-size sheet P2*a*, the sheet interval (i.e., the space between adjacent sheets) is reduced from the sheet interval D2*a* (see FIG. 18) to the sheet interval D2*b* (see FIG. 19). As described above, the space interval between the first small-size sheet P2*a* and the second small-size sheet P2*b* is reduced along with the reduction of the conveyance speed. However, the first small-size sheet P2*a* is reduced so that the leading end of the second small-size sheet P2*b* does not contact the trailing end of the first small-size sheet P2*a*.

Specifically, the sheet interval D2 between adjacent small-size sheets P2 is greater than the space D1 between adjacent large-size sheets P1 by the difference G (=L1−L2) of the large-size sheet P1 and the small-size sheet P2 in the sheet conveyance direction (see FIG. 17). For this reason, the conveyance speed of a preceding sheet can be delayed until the sheet interval D2 between adjacent small-size sheets P2 is reduced by the difference G. Accordingly, when the small-size sheet P2 is conveyed, the conveyance speed of the preceding sheet can be reduced until the space interval between the preceding sheet and the subsequent sheet is reduced by the difference G of the large-size sheet P1 and the small-size sheet P2 at most. Since multiple small-size sheets P2 are conveyed by the correction roller pair 31 at the conveyance speed after reduction, a longer time for correcting the displacement of a sheet by the correction roller pair 31 can be obtained. The second and subsequent small-sized sheets (for example, a small-size sheet P2*c*) are also conveyed in the same manner as the first small-sized sheet P2*a*.

As described above, in the present embodiment, by using the fact that the sheet interval of the small-size sheets is greater than the sheet interval of the large-size sheets, the conveyance speed of the preceding sheet is reduced. By so doing, the contact between the preceding sheet and the succeeding sheet can be avoided and a longer time for correcting the displacement of a sheet by the correction roller pair 31 can be obtained. Accordingly, the accuracy in correction of the displacement of a sheet by the correction roller pair 31 can be enhanced, and a sheet can be conveyed to the first transfer cylinder 8 accurately.

The timing and degree of reduction of a small-size sheet may be appropriately set within a range in which the subsequent sheet does not come into contact with the preceding sheet in consideration of correction accuracy. In other words, the timing and degree of reduction of a sheet can be appropriately changed as long as the sheet interval between a preceding sheet and a succeeding sheet following the preceding sheet is reduced by the difference G between the lengths of the large-size sheet P1 and the small-size sheet P2 in the sheet conveyance direction at the maximum. The conveyance speed is reduced by the conveyance speed controller 25.

The reduction of the small-size sheet may be started at a timing before the preceding sheet reaches the correction roller pair 31 or at a timing after the preceding sheet reaches the correction roller pair 31. In other words, as long as the small-size sheet is conveyed by the correction roller pair 31 at the lower conveyance speed after reduced during the sheet conveyance, the reduction of the conveyance speed may be started at a timing before the preceding sheet reaches the correction roller pair 31 or a timing after the preceding sheet reaches the correction roller pair 31.

The time during which the small-size sheet is conveyed at the reduced conveyance speed may be the whole time during which the sheet is conveyed by the correction roller pair 31 or may be part of the time during which the sheet is conveyed by the correction roller pair 31. Accordingly, within at least a part of the time during which the correction roller pair 31 can perform the secondary correction, the small-size sheet may be conveyed at the conveyance speed after the reduction. In this case, since a longer time for performing the secondary correction can be obtained, the correction precision in the secondary correction can be enhanced. The time during which the small-size sheet is conveyed at the conveyance speed after the reduction may be within at least a part of the time during which the correction roller pair 31 can perform the primary correction.

Figure 20:
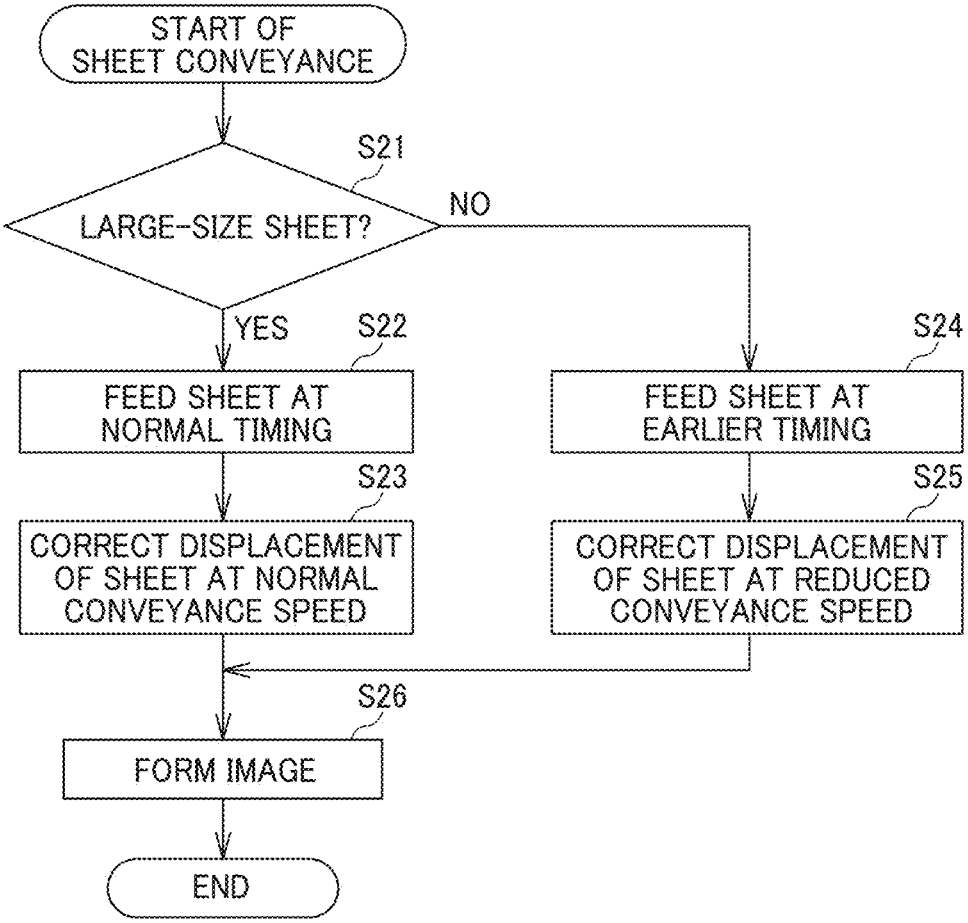
FIG. 20 is a flowchart of a conveying operation when the large-size sheets and the small-size sheets are conveyed.

FIG. 20 is a flowchart of a conveying operation when the large-size sheets and the small-size sheets are conveyed in the sheet conveying device according to the present embodiment.

As illustrated in FIG. 20, as the conveying operation of the sheets, it is determined that the sheet to be conveyed is a large-size sheet or a small-size sheet (step S21 in the flowchart of FIG. 20). The sheet size at this time is determined by the controller 20 (see FIG. 6) based on, for example, a signal from the detection sensor that detects the sheet size or information of the sheet size input by a user.

As a result, when the sheet is a large-size sheet (YES in step S21), the large-size sheet is fed at a normal timing (step S22 in the flowchart of FIG. 20) Then, the displacement of the large-size sheet is corrected at the normal conveyance speed (step S23 in the flowchart of FIG. 20). After the displacement of the large-size sheet is corrected by the correction roller pair 31, an image is formed on the sheet (step S26 in the flowchart of FIG. 20).

On the other hand, when the sheet is a small-size sheet (NO in step S21), the small-small-size sheet is fed at a timing earlier than the timing at which the large-size sheet is fed (step S24 in the flowchart of FIG. 20). In other words, in the case of the small-size sheet, since the conveyance speed is reduced in the middle of the sheet conveyance as described above, the small-size sheet is fed at a timing earlier than the timing at which the large-size sheet is fed, so that the small-size sheet is not delayed from the timing at which the gripper 16 of the first transfer cylinder 8 reaches the receiving position A. For example, when the sheet interval between the small-size sheets is reduced by the difference G between the lengths of the large-size sheet and the small-size sheet in the sheet conveyance direction, the small-size sheet may be fed earlier by a time obtained by dividing the difference G by the conveyance speed V1 before the reduction. Then, the displacement of the small-size sheet is corrected at the reduced conveyance speed (step S25 in the flowchart of FIG. 20). After the displacement of the small-size sheet is corrected by the correction roller pair 31, an image is formed on the sheet (step S26).

As described above, in the case of conveyance of a small-size sheet, the small-size sheet is fed earlier in advance by the time delayed due to the reduction in the conveyance speed. By so doing, the small-size sheet can be conveyed in synchrony with the timing at which the gripper 16 reaches the receiving position A. Further, in order to eliminate the delay of conveyance of a small-size sheet to the receiving position A, the conveyance speed of a small-size sheet may be increased between the correction roller pair 31 and the first transfer cylinder 8. Further, the conveyance speed of a sheet may be adjusted so that the sheet can accurately follow the speed of movement of the gripper 16.

The above-described embodiments are illustrative and do not limit the present disclosure. It is therefore to be understood that within the scope of the appended claims, numerous additional modifications and variations are possible to this disclosure otherwise than as specifically described herein.

The present disclosure is not limited to be applied to the sheet conveying device according to the present embodiment that conveys two kinds of sheets having different lengths in the sheet conveyance direction. For example, the present disclosure may be applied to a sheet conveying device that conveys three or more kinds of sheets having different lengths in the sheet conveyance direction. In other words, when sheets among different kinds of sheets are smaller in size than the maximum-size sheet, the sheet interval between the sheets is greater than the sheet interval of the maximum-size sheet. Thus, by using the size of the sheet interval, the conveyance speed of the preceding sheet can be reduced. Accordingly, when a small-size sheet smaller than the maximum-size sheet is conveyed, the conveyance speed of the small-size sheet is reduced, and the correction roller pair 31 conveys the small-size sheet at the reduced conveyance speed. Accordingly, a longer time for correcting the displacement of a sheet can be obtained. In this case, the conveyance speed of the sheet can be reduced until the sheet interval of the small-size sheets is reduced at the maximum by the difference in length in the sheet conveyance direction between the maximum-size sheet and the small-size sheet.

Further, the relation of the large-size sheet and the small-size sheet in the above-described embodiment is not limited to the relation of the maximum-size sheet and the small-size sheet smaller than the maximum-size sheet, but is also established in the relation of the medium-size sheet smaller than the maximum-size sheet and the minimum-size sheet smaller than the maximum-size sheet. Accordingly, in a sheet conveying device that can convey three different types of sheets having different lengths in the sheet conveyance direction, the conveyance speed of a sheet is reduced only when the minimum-size sheet, in particular, is conveyed, so that a longer time for correcting the displacement of the sheet can be obtained.

The present disclosure is not limited to a sheet conveying device that conveys a sheet at a timing in synchrony with movement of the gripper 16 of the first transfer cylinder 8. For example, the present disclosure may also be applied to another sheet conveying device having different configuration in which the sheets are to be conveyed at timings of equal intervals. In such a configuration, the small-size sheet is conveyed with a larger sheet interval than the large-size sheet. For this reason, by reducing the conveyance speed by using the length of the sheet interval of small-size sheets, a longer time for correcting the displacement of the sheet can be obtained.

Further, the present disclosure is not limited to the configuration in which the corrector such as the correction roller pair is movable in both the width direction of the sheet and the rotational direction within a plane of sheet conveyance. For example, the present disclosure is also applicable to a configuration in which the corrector is movable in only one of the width direction or the rotational direction.

In the above-described embodiments, CISs are used as position detectors to detect the position of the side end of a sheet. However, the position detector is not limited to a CIS and may be any detector such as multiple photosensors disposed along the width direction of the sheet as long as the detector detects the side end of a sheet.

Figure 21:
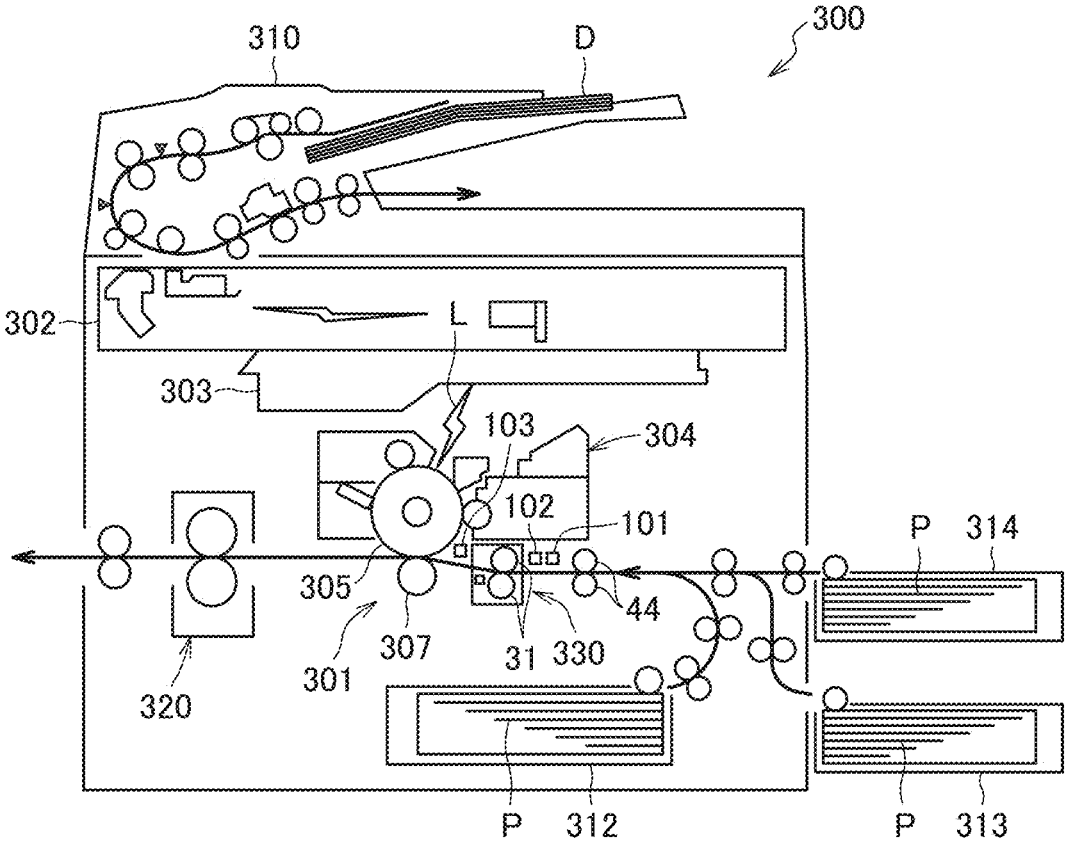
FIG. 21 is a diagram illustrating an electrophotographic image forming apparatus including the sheet conveying device according to an embodiment of the present disclosure.

The sheet conveying device according to the present disclosure is not limited to the inkjet image forming apparatus as illustrated in FIG. 1 and may be applied to an electrophotographic image forming apparatus as illustrated in FIG. 21.

FIG. 21 is a diagram illustrating an electrophotographic image forming apparatus 300 including the sheet conveying device 7 according to an embodiment of the present disclosure.

In FIG. 21, the electrophotographic image forming apparatus 300 includes an image forming device 301, a document reading device 302, a document conveying device 310, a first sheet tray 312, a second sheet tray 313, a third sheet tray 314, a fixing device 320, and a sheet conveying device 330.

The image forming device 301 forms an image on a sheet P. The document reading device 302 optically reads image data of an original document D. The document conveying device 310 functions as a document feeder that conveys the original document D set on a document tray or a document loader to the document reading device 302. Each of the first sheet tray 312, the second sheet tray 313 and the third sheet tray 314 contains the sheet P. The fixing device 320 fixes an unfixed image formed on the sheet P to the sheet P by application of heat and pressure. The sheet conveying device 330 conveys the sheet P fed by any one of the first sheet tray 312, the second sheet tray 313 and the third sheet tray 314. Further, the image forming device 301 includes a photoconductor drum 305, an exposure device 303, a developing device 304, and a transfer unit 307. The exposure device 303 emits an exposure light L based on the image data read by the document reading device 302 to the photoconductor drum 305. The developing device 304 forms a toner image on the surface of the photoconductor drum 305. The transfer unit 307 transfers the toner image formed on the surface of the photoconductor drum 305 onto a sheet P.

When the document D is conveyed by the document conveying device 310 in the direction indicated by arrow in FIG. 21 and the image data of the document D is read by the document reading device 302, based on the image information, the exposure device 303 emits the exposure light L based on the image data to the charged surface of the photoconductor drum 305. Consequently, an electrostatic latent image is formed on the surface of the photoconductor drum 305. Subsequently, the developing device 304 supplies toner onto the electrostatic latent image formed on the photoconductor drum 305, so that the electrostatic latent image on the photoconductor drum 305 is developed into a toner image (visible image). The sheet P fed from any one of the first sheet tray 312, the second sheet tray 313, and the third sheet tray 314 is conveyed to the transfer unit 307 by the sheet conveying device 330, so that the toner image formed on the photoconductor drum 305 is transferred onto the sheet P. After this operation, the sheet P is conveyed to the fixing device 320. After the toner image is fixed in the fixing device 320, the sheet P is discharged to the outside of the electrophotographic image forming apparatus 300.

In the electrophotographic image forming apparatus 300, it is desired that the sheet P is conveyed to the transfer unit 307 with good accuracy in synchrony with movement of the toner image on the photoconductor drum 305. As a result, the displacement of the sheet P is corrected by the sheet conveying device 330 so that the image forming apparatus 300 can convey the sheet P with good accuracy. However, if the conveyance speed of the sheet P is increased or the sheet conveyance passage is shortened to enhance the productivity and reduce the size of the image forming apparatus 300, the time for correcting the displacement of a sheet cannot be sufficiently obtained, which is similar to the inconvenience occurred in the above-described inkjet image forming apparatus.

In the sheet conveying device 330 illustrated in FIG. 21, when multiple small-size sheets are consecutively conveyed, the conveyance speed of the small-size sheets is reduced, so that the correction roller pair 31 conveys the sheet at the reduced conveyance speed. By so doing, the time for displacement of the sheet can be longer.

Some aspects of the above embodiments of the present disclosure that relate to a sheet conveying device and an image forming apparatus are given below:

First Aspect

In a first aspect, a sheet conveying device (for example, the sheet conveying device 7) includes a sensor (for example, the first CIS 101, the second CIS 102, the third CIS 103), a corrector (for example, the correction roller pair 31), and circuitry (for example, the controller 20). The sensor detects a sheet of multiple sheets including a large-size sheet and a small-size sheet having a length shorter than a length of the large-size sheet in a sheet conveyance direction. The corrector corrects a position of the sheet in at least one of a rotational direction or a width direction within a plane of sheet conveyance. The circuitry is to convey the large-size sheet and the small-size sheet, reduce a first conveyance speed of a preceding small-size sheet to a second conveyance speed until a space between a trailing end of a preceding small-size sheet of multiple small-size sheets and a leading end of a subsequent small-size sheet of the multiple small-size sheets is reduced by a difference (for example, the difference G) at maximum of the length of the large-size sheet and the length of the small-size sheet in the sheet conveyance direction when the multiple small-size sheets including the small-size sheet are continuously conveyed, and cause the corrector to convey the small-size sheet at the second conveyance speed within at least a part of time in which the small-size sheet is conveyed by the corrector.

Second Aspect

In a second aspect, the sheet conveying device (for example, the sheet conveying device 7) according to the configuration of the first aspect further includes a downstream conveyor (for example, the first transfer cylinder 8) downstream from the corrector (for example, the correction roller pair 31) in the sheet conveyance direction to convey the sheet. The downstream conveyor serves as a rotary conveyor with a sheet receiver (for example, the gripper 16) mounted on a surface of the rotary conveyor or multiple sheet receivers (for example, the gripper 16) mounted at equal intervals on a surface of the rotary conveyor, and rotates to cause the sheet receiver or the multiple sheet receivers to reach, at a given timing, a receiving position at which the sheet receiver or the multiple sheet receivers receive the sheet. The large-size sheet and the small-size sheet are conveyed to meet an arrival timing of the sheet receiver or the multiple sheet receivers to the receiving position.

Third Aspect

In a third aspect, according to the configuration of the second aspect, a timing at which the small-size sheet is conveyed to the corrector (for example, the correction roller pair 31) is earlier than a timing at which the large-size sheet is conveyed to the corrector.

Fourth Aspect

In a fourth aspect, according to the configuration of any one of the first to third aspects, the sensor (for example, the first CIS 101, the second CIS 102, the third CIS 103) performs a first detection to detect an initial position of the sheet, and a second detection to detect a position of the sheet downstream from the initial position in the first detection in the sheet conveyance direction. The corrector (for example, the correction roller pair 31) performs a primary correction to correct the position of the sheet in at least one of the rotational direction or the width direction within a plane of sheet conveyance in accordance with the position of the sheet detected by the first detection, and a secondary correction to correct the position of the sheet in at least one of the rotational direction or the width direction within a plane of sheet conveyance in accordance with the position of the sheet detected by the second detection. The corrector conveys the small-size sheet at the second conveyance speed within at least a part of time in which the secondary correction is performed.

Fifth Aspect

In a fifth aspect, according to the configuration of any one of the first to fourth aspects, the large-size sheet is a sheet having a maximum length in the sheet conveyance direction in which the multiple sheets are conveyed.

Sixth Aspect

In a sixth aspect, an image forming apparatus (for example, the image forming apparatus 100) includes the sheet conveying device (for example, the sheet conveying device 7) according to the configuration of any one of the first to fifth aspects, and an image former (for example, the image forming device 2) to form an image on the sheet conveyed by the sheet conveying device.

Seventh Aspect

In a seventh aspect, a sheet conveying device (for example, the sheet conveying device 7) includes a sensor (for example, the first CIS 101, the second CIS 102, the third CIS 103), a corrector (for example, the correction roller pair 31), and circuitry (for example, the controller 20). The sensor detects a position of a sheet among a first sheet having a first length and multiple second sheets each having a second length shorter than the first length in a sheet conveyance direction of the sheet. The corrector corrects the position of the sheet in at least one of a rotational direction or a width direction orthogonal to the sheet conveyance direction within a plane of sheet conveyance based on the position of the sheet detected by the sensor. The circuitry is to convey the multiple second sheets at a first conveyance speed, reduce the first conveyance speed of a preceding one of the multiple second sheets to a second conveyance speed lower than the first conveyance speed until a space between a trailing end of the preceding one of the multiple second sheets and a leading end of a subsequent one of the multiple second sheets becomes a difference (for example, the difference G) between the first length of the first sheet and the second length of the multiple second sheets in the sheet conveyance direction while continuously conveying the multiple second sheets, and cause the corrector to convey one of the multiple second sheets at the second conveyance speed within at least a part of time in which said one of the multiple second sheets is conveyed by the corrector.

Eighth Aspect

In an eighth aspect, the sheet conveying device (for example, the sheet conveying device 7) according to the configuration of the seventh aspect further includes a downstream conveyor (for example, the first transfer cylinder 8) downstream from the corrector (for example, the correction roller pair 31) in the sheet conveyance direction to convey the sheet. The downstream conveyor includes a rotary conveyor including a sheet receiver (for example, the gripper 16) on a surface of the rotary conveyor. The rotary conveyor rotates to cause the sheet receiver to reach, at a given timing, a receiving position at which the sheet receiver receives the sheet. The circuitry (for example, the controller 20) cause the corrector to convey the first sheet and the multiple second sheet to the receiving position of the rotary conveyor at the given timing.

Ninth Aspect

In a ninth aspect, according to the configuration of the eighth aspect, a first timing at which the multiple second sheets are conveyed to the corrector (for example, the correction roller pair 31) is earlier than a second timing at which the first sheet is conveyed to the corrector.

Tenth Aspect

In a tenth aspect, according to the configuration of any one of the seventh to ninth aspects, the circuitry (for example, the controller 20) is to cause the sensor (for example, the first CIS 101, the second CIS 102, the third CIS 103) to detect a first position of the sheet as a first detection, and detect a second position of the sheet downstream from the first position in the sheet conveyance direction as a second detection after the first detection. The corrector (for example, the correction roller pair 31) performs a primary correction to correct the first position of the sheet in at least one of the rotational direction or the width direction within the plane of sheet conveyance in accordance with the first position by the first detection, and a secondary correction to correct the second position of the sheet in at least one of the rotational direction or the width direction within the plane of sheet conveyance in accordance with the second position by the second detection. The corrector conveys the multiple second sheets at the second conveyance speed within at least a part of time in which the secondary correction is performed.

Eleventh Aspect

In an eleventh aspect, according to the configuration of the tenth aspect, the circuitry (for example, the controller 20) is to cause the sensor (for example, the first CIS 101, the second CIS 102, the third CIS 103) to detect a third position of the sheet downstream from the correction in the sheet conveyance direction as a third detection after the second detection, and the corrector (for example, the correction roller pair 31) performs the secondary correction to correct the second position of the sheet in at least one of the rotational direction or the width direction within the plane of sheet conveyance in accordance with the second position by the second detection and the third position by the third detection.

Twelfth Aspect

In a twelfth aspect, according to the configuration of the eleventh aspect, the circuitry (for example, the controller 20) is to perform the secondary correction multiple times during the sheet is conveyed between the second position and the third position.

Thirteenth Aspect

In a thirteenth aspect, according to the configuration of any one of the seventh to twelfth aspects, the first sheet has a maximum length in the sheet conveyance direction among the first sheet and the multiple second sheets conveyed by the sheet conveying device.

Fourteenth Aspect

In a fourteenth aspect, an image forming apparatus (for example, the image forming apparatus 100) includes the sheet conveying device (for example, the sheet conveying device 7) according to the configuration of any one of the seventh to thirteenth aspects, and an image former (for example, the image forming device 2) to form an image on the sheet conveyed by the sheet conveying device.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a sensor to detect a position of a sheet among a first sheet having a first length and multiple second sheets each having a second length shorter than the first length in a sheet conveyance direction of the sheet;

a corrector to correct the position of the sheet in at least one of a rotational direction or a width direction orthogonal to the sheet conveyance direction within a plane of sheet conveyance based on the position of the sheet detected by the sensor; and circuitry configured to:

convey the multiple second sheets at a first conveyance speed;

reduce the first conveyance speed of a preceding one of the multiple second sheets to a second conveyance speed lower than the first conveyance speed until a space between a trailing end of the preceding one of the multiple second sheets and a leading end of a subsequent one of the multiple second sheets becomes a difference between the first length of the first sheet and the second length of the multiple second sheets in the sheet conveyance direction while continuously conveying the multiple second sheets; and cause the corrector to convey one of the multiple second sheets at the second conveyance speed within at least a part of time in which said one of the multiple second sheets is conveyed by the corrector.

2. The sheet conveying device according to claim 1, further comprising a downstream conveyor downstream from the corrector in the sheet conveyance direction to convey the sheet, wherein the downstream conveyor includes a rotary conveyor including a sheet receiver on a surface of the rotary conveyor, the rotary conveyor rotates to cause the sheet receiver to reach, at a given timing, a receiving position at which the sheet receiver receives the sheet, and the circuitry cause the corrector to convey the first sheet and the multiple second sheet to the receiving position of the rotary conveyor at the given timing.

3. The sheet conveying device according to claim 2, wherein a first timing at which the multiple second sheets are conveyed to the corrector is earlier than a second timing at which the first sheet is conveyed to the corrector.

4. The sheet conveying device according to claim 1, wherein the circuitry cause the sensor to:

detect a first position of the sheet as a first detection; and detect a second position of the sheet downstream from the first position in the sheet conveyance direction as a second detection after the first detection, the corrector performs:

a primary correction to correct the first position of the sheet in at least one of the rotational direction or the width direction within the plane of sheet conveyance in accordance with the first position by the first detection; and a secondary correction to correct the second position of the sheet in at least one of the rotational direction or the width direction within the plane of sheet conveyance in accordance with the second position by the second detection, and the corrector conveys the multiple second sheets at the second conveyance speed within at least a part of time in which the secondary correction is performed.

5. The sheet conveying device according to claim 4, wherein the circuitry is configured to cause the sensor to detect a third position of the sheet downstream from the correction in the sheet conveyance direction as a third detection after the second detection, and the corrector performs the secondary correction to correct the second position of the sheet in at least one of the rotational direction or the width direction within the plane of sheet conveyance in accordance with the second position by the second detection and the third position by the third detection.

6. The sheet conveying device according to claim 5, wherein the circuitry is configured to perform the secondary correction multiple times during the sheet is conveyed between the second position and the third position.

7. The sheet conveying device according to claim 1, wherein the first sheet has a maximum length in the sheet conveyance direction among the first sheet and the multiple second sheets conveyed by the sheet conveying device.

8. An image forming apparatus comprising:

the sheet conveying device according to claim 1; and an image former to form an image on the sheet conveyed by the sheet conveying device.

* * * * *